US012378832B2

(12) United States Patent
Least et al.

(10) Patent No.: US 12,378,832 B2
(45) Date of Patent: Aug. 5, 2025

(54) EXPANDABLE METAL SEALING/ANCHORING TOOL

(71) Applicant: Halliburton Energy Services, Inc., Houston, TX (US)

(72) Inventors: Brandon T. Least, Carrollton, TX (US); Michael Linley Fripp, Carrollton, TX (US); Shanu Thottungal Eldho, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/493,944

(22) Filed: Oct. 5, 2021

(65) Prior Publication Data

US 2023/0109351 A1 Apr. 6, 2023

(51) Int. Cl.
*E21B 23/01* (2006.01)
*E21B 33/12* (2006.01)

(52) U.S. Cl.
CPC ..... *E21B 23/01* (2013.01); *E21B 33/1208* (2013.01)

(58) Field of Classification Search
CPC ... E21B 23/01; E21B 33/1208; E21B 33/1212
See application file for complete search history.

(56) References Cited

U.S. PATENT DOCUMENTS 1,525,740 A 2/1925 Howard
2,075,912 A 4/1937 Roye
2,590,931 A 4/1952 Cabaniss
2,743,781 A 5/1956 Lane
2,865,454 A 12/1958 Richards
3,206,536 A 9/1965 Goodloe
3,298,440 A * 1/1967 Current ..... E21B 33/1216 166/134

(Continued)

FOREIGN PATENT DOCUMENTS

CA 2820742 A1 9/2013
CN 203308412 U * 11/2013

(Continued)

OTHER PUBLICATIONS

Fripp, Michael, and Zachary Walton. "Degradable Metal for Use in a Fully Dissolvable Frac Plug." Paper presented at the Offshore Technology Conference, Houston, Texas, USA, May 2016. doi: https://doi.org/10.4043/27187-MS (Year: 2016).*

(Continued)

*Primary Examiner* — Theodore N Yao
(74) *Attorney, Agent, or Firm* — Scott Richardson; Parker Justiss, P.C.

(57) ABSTRACT

Provided is a sealing/anchoring element, a sealing/anchoring tool, and a method for sealing/anchoring within a wellbore. The sealing/anchoring element, in one aspect, includes a circlet having an inside surface having an inside diameter ($d_i$), an outside surface having an outside diameter ($d_o$), a width (w), and a wall thickness (t). In one aspect, the circlet has one or more geometric features that allow it to elasto/plastically deform when moved from a radially reduced state to a radially enlarged state, and the circlet comprises an expandable metal configured to expand in response to hydrolysis.

20 Claims, 40 Drawing Sheets

(56) References Cited

U.S. PATENT DOCUMENTS 3,371,716 A 3/1968 Current
3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1* 7/2002 Swor ..... E21B 33/1292 166/387
2003/0132001 A1 7/2003 Wilson
2003/0164236 A1 9/2003 Thornton
2003/0164237 A1 9/2003 Butterfield, Jr.
2003/0188876 A1 10/2003 Vick et al.
2003/0205377 A1 11/2003 Streater
2004/0194970 A1 10/2004 Eatwell
2004/0216893 A1 11/2004 Hirth
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1* 6/2008 Marya ..... E21B 23/00 166/387
2008/0290603 A1 11/2008 Laflin
2009/0014173 A1* 1/2009 MacLeod ..... E21B 23/01 166/216
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1* 6/2010 Patel ..... E21B 33/1208 166/387
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1* 12/2010 Mellemstrand ..... F16L 55/132 166/118
2011/0061876 A1 3/2011 Johnson et al.
2011/0098202 A1* 4/2011 James ..... C09K 8/5086 507/221
2011/0147014 A1 6/2011 Chen et al.
2011/0290473 A1 12/2011 Frazier
2012/0018143 A1* 1/2012 Lembcke ..... E21B 33/1208 166/134

(56) References Cited

U.S. PATENT DOCUMENTS

2012/0048531 A1 3/2012 Marzouk
2012/0048561 A1 3/2012 Holderman
2012/0048623 A1 3/2012 Lafuente et al.
2012/0049462 A1 3/2012 Pitman
2012/0118561 A1* 5/2012 Frazier ..... E21B 34/063 166/135
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1* 1/2015 Davis ..... E21B 33/1208 166/208
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0130553 A1* 5/2017 Harris ..... E21B 33/1291
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1* 2/2018 Walton ..... E21B 23/06
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1 4/2018 Perez
2018/0128072 A1 5/2018 Larsen
2018/0128082 A1 5/2018 Hollan et al.
2018/0163502 A1 6/2018 Eidem et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0189830 A1 6/2021 Greci et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
NL 2025837 A 2/2021
WO 02/02900 A2 1/2002

(56) References Cited

FOREIGN PATENT DOCUMENTS

| | | | |
|---|---|---|---|
| WO | 02/02900 | A3 | 5/2002 |
| WO | 02/02900 | A8 | 12/2003 |
| WO | 2005/022012 | A1 | 3/2005 |
| WO | 2006/045794 | A1 | 5/2006 |
| WO | 2007/047089 | A1 | 4/2007 |
| WO | 2012/094322 | A2 | 7/2012 |
| WO | 2012/125660 | A2 | 9/2012 |
| WO | 2012/094322 | A3 | 10/2012 |
| WO | 2012/125660 | A3 | 2/2013 |
| WO | 2014/028149 | A1 | 2/2014 |
| WO | 2014/182301 | A1 | 11/2014 |
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

OTHER PUBLICATIONS

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

* cited by examiner

EXPANDABLE METAL SEALING/ANCHORING TOOL

BACKGROUND

A typical sealing/anchoring tool (e.g., packer, bridge plug, frac plug, etc.) generally has one or more sealing elements or "rubbers" that are employed to provide a fluid-tight seal radially between a mandrel of the sealing/anchoring tool, and the casing or wellbore into which the sealing/anchoring tool is disposed. A typical sealing/anchoring tool may additionally include one or more anchoring elements (e.g., slip rings) which grip the casing and prevent movement of the sealing/anchoring tool within the casing after the sealing elements have been set. Thus, if weight or fluid pressure is applied to the sealing/anchoring tool, the anchoring elements resist the axial forces on the sealing/anchoring tool produced thereby, and prevent axial displacement of the sealing/anchoring tool relative to the casing and/or wellbore. Such a sealing/anchoring tool is commonly conveyed into a subterranean wellbore suspended from tubing extending to the earth's surface.

To prevent damage to the elements of the sealing/anchoring tool while the sealing/anchoring tool is being conveyed into the wellbore, the sealing elements and/or anchoring elements may be carried on the mandrel in a relaxed or uncompressed state, in which they are radially inwardly spaced apart from the casing. When the sealing/anchoring tool is set, the sealing elements and/or anchoring elements radially expand (e.g., both radially inward and radially outward in certain instances), thereby sealing and/or anchoring against the mandrel and the casing and/or wellbore. In certain embodiments, the sealing elements and/or anchoring elements are axially compressed between element retainers that straddle them, which in turn radially expand the sealing elements and/or anchoring elements. In other embodiments, the sealing elements and/or anchoring elements are radially expanded by pulling a cone feature therethrough. In yet other embodiments, one or more swellable seal elements are axially positioned between the element retainers, the swellable seal elements configured to radially expand when subjected to one or more different swelling fluids.

BRIEF DESCRIPTION

Reference is now made to the following descriptions taken in conjunction with the accompanying drawings, in which.

DETAILED DESCRIPTION

Figure 1A:
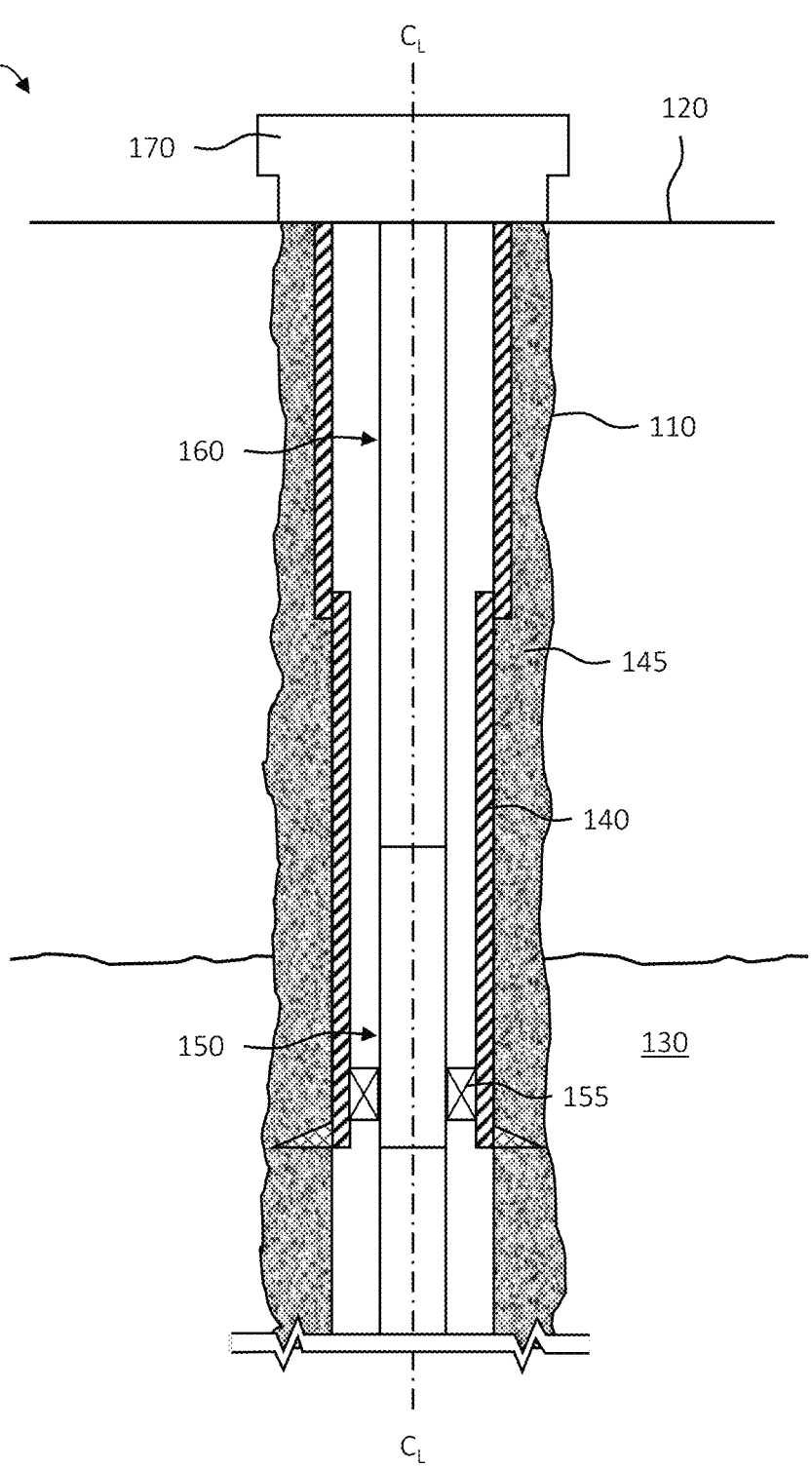
FIG. 1A illustrates a well system designed, manufactured, and operated according to one or more embodiments of the disclosure, the well system including a sealing/anchoring tool including a sealing/anchoring element designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure describes a sealing/anchoring element employing expandable/expanded metal as a seal and/or anchor in a sealing/anchoring tool. The expandable/expanded metal may embody many different locations, sizes and shapes within the sealing/anchoring element while remaining within the scope of the present disclosure. In at least one embodiment, the expandable/expanded metal reacts with fluids within the wellbore to create a sturdy sealing/anchoring tool. Accordingly, the use of the expandable/expanded metal within the sealing/anchoring element minimizes the likelihood of the sealing/anchoring tool leaks and/or axially slips.

FIG. 1A illustrates a well system 100 designed, manufactured, and operated according to one or more embodiments of the disclosure, the well system 100 including a sealing/anchoring tool 150 including a sealing/anchoring element 155 designed, manufactured and operated according to one or more embodiments of the disclosure. The well system 100 includes a wellbore 110 that extends from a terranean surface 120 into one or more subterranean zones 130. When completed, the well system 100 produces reservoir fluids and/or injects fluids into the subterranean zones 130. As those skilled in the art appreciate, the wellbore 110 may be fully cased, partially cased, or an open hole wellbore. In the illustrated embodiment of FIG. 1, the wellbore 110 is at least partially cased, and thus is lined with casing or liner 140. The casing or liner 140, as is depicted, may be held into place by cement 145.

An example well sealing/anchoring tool 150 is coupled with a tubing string 160 that extends from a wellhead 170 into the wellbore 110. The tubing string 160 can be coiled tubing and/or a string of joint tubing coupled end to end. For example, the tubing string 160 may be a working string, an injection string, and/or a production string. The sealing/anchoring tool 150 can include a bridge plug, frac plug, packer (e.g., production packer) and/or other sealing/anchoring tool, having a sealing/anchoring element 155 for sealing/anchoring against the wellbore 110 wall (e.g., the casing 140, a liner and/or the bare rock in an open hole context). The sealing/anchoring element 155 can isolate an interval of the wellbore 110 above the sealing/anchoring element 155 from an interval of the wellbore 110 below the sealing/anchoring element 155, for example, so that a pressure differential can exist between the intervals.

In accordance with the disclosure, the sealing/anchoring element 155 may include a circlet having an inside surface having an inside diameter ($d_i$), an outside surface having an outside diameter ($d_o$), a width (w), and a wall thickness (t), the circlet having one or more geometric features that allow it to elasto/plastically deform when moved from a radially reduced state to a radially enlarged state. The term elasto/plastically, as used herein, refers to mechanical deformation and means that the circlet may elastically deform, may plastically deform, or may both elastically and plastically deform.

In accordance with one embodiment of the disclosure, the circlet comprises an expandable metal configured to expand in response to hydrolysis. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, and surface-area-to-volume ratio (SA:V) of the expandable metal.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal, in certain embodiments, has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow AlO(OH)+3/2H_2$$

$$Al+3/2H_2O \rightarrow \tfrac{1}{2}Al_2O_3+3/2\ H_2$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it is meant that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_3ClO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for sealing the leak. For example, the expandable metal may be formed into a single long member, multiple short members, rings, among others. In another embodiment, the expandable metal may be formed into a long wire of expandable metal, that can be in turn be wound around a tubular as a sleeve. The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material.

Figure 1B:
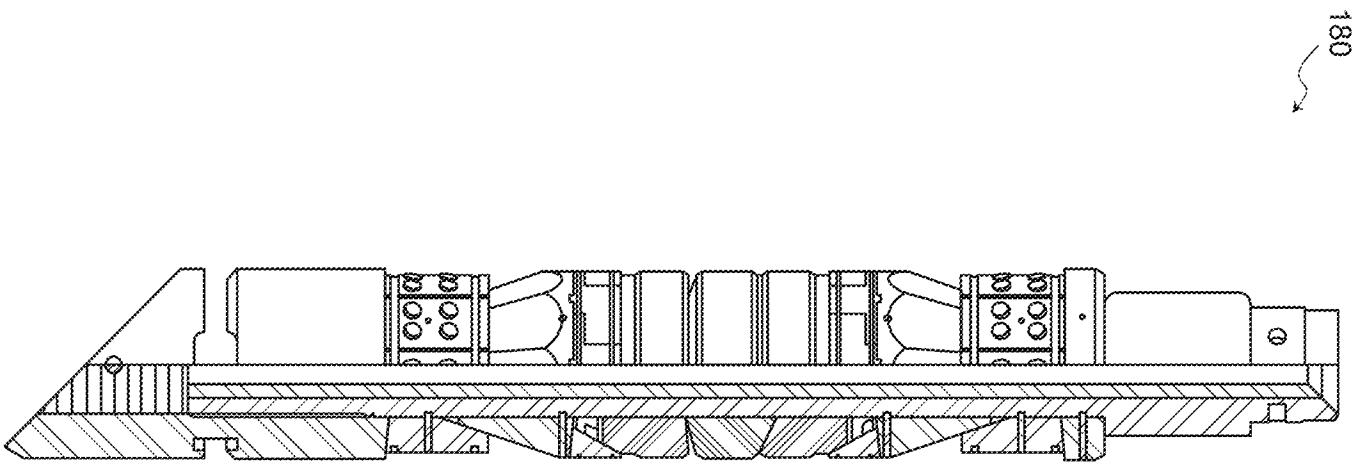
FIG. 1B illustrates one embodiment of a frac plug designed, manufactured and operated according to one or more embodiments of the disclosure.

Turning briefly to FIG. 1B, illustrated is one embodiment of a frac plug 180 designed, manufactured and operated according to one or more embodiments of the disclosure. The frac plug 180, in the illustrated embodiment, could function as the sealing/anchoring element 150 of FIG. 1A. Accordingly, the frac plug 180 could include the aforementioned circlet, for example a circlet comprising an expandable metal configured to expand in response to hydrolysis.

Figure 1C:
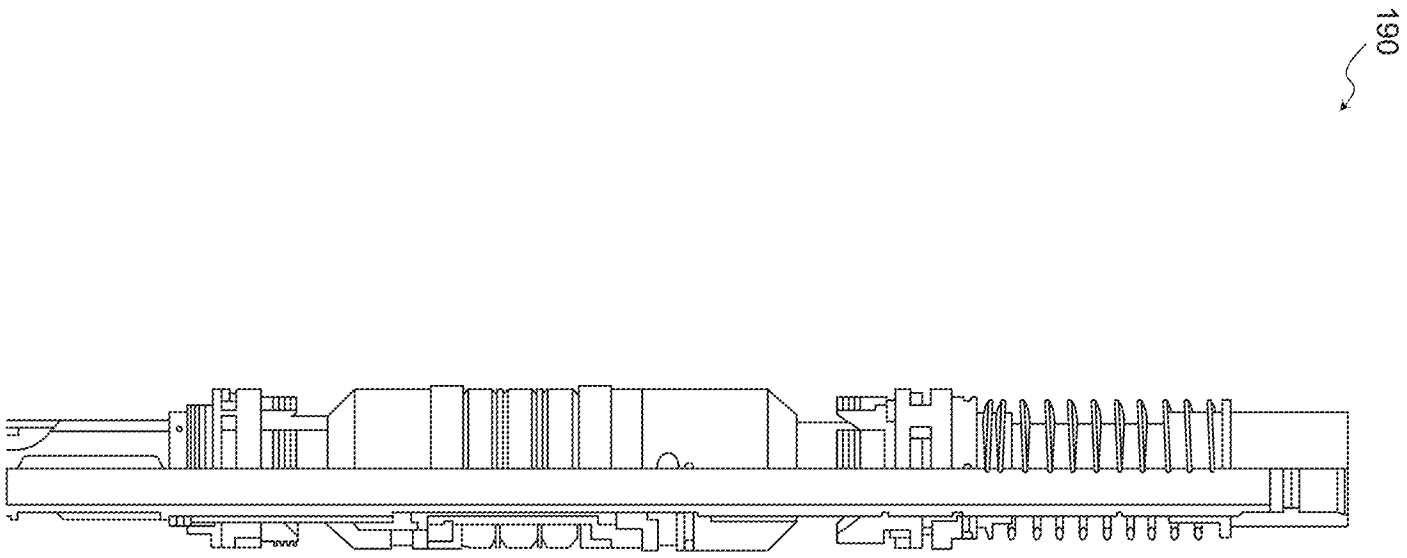
FIG. 1C illustrates one embodiment of a production packer designed, manufactured and operated according to one or more embodiments of the disclosure.

Turning briefly to FIG. 1C, illustrated is one embodiment of a production packer 190 designed, manufactured and operated according to one or more embodiments of the disclosure. The production packer 190, in the illustrated embodiment, could function as the sealing/anchoring element 150 of FIG. 1A. Accordingly, the production packer 190 could include the aforementioned circlet, for example a circlet comprising an expandable metal configured to expand in response to hydrolysis.

Figure 2:
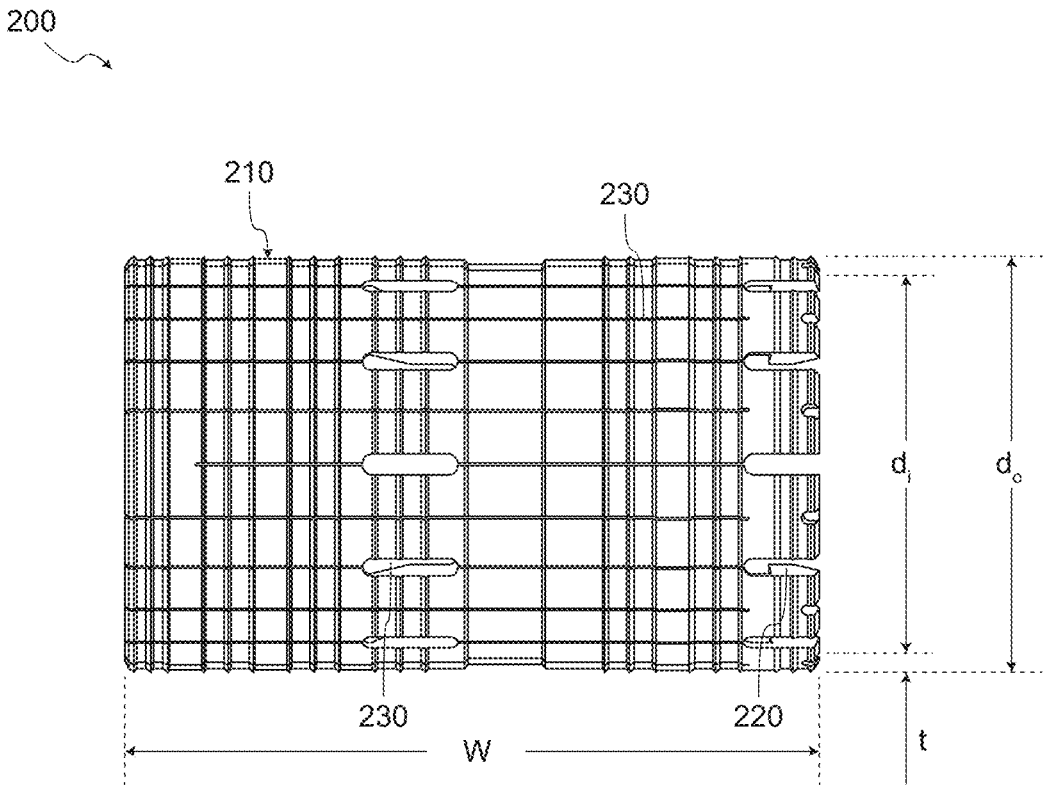
FIG. 2 illustrates one embodiment of a sealing/anchoring element designed, manufactured and operated according to one embodiment of the disclosure.

Turning to FIG. 2, illustrated is one embodiment of a sealing/anchoring element 200 designed, manufactured and operated according to one embodiment of the disclosure. The sealing/anchoring element 200, in the illustrated embodiment, includes a circlet 210 having an inside surface with an inside diameter ($d_i$), an outside surface with an outside diameter ($d_o$), a width (w), and a wall thickness (t). The circlet 210, in the illustrated embodiment, additionally includes one or more geometric features that allow it to elasto/plastically deform when moved from a radially reduced state to a radially enlarged state. Further to the embodiment of FIG. 2, the circlet 210 comprises an expandable metal configured to expand to hydrolysis, such as discussed in the paragraphs above.

In at least one embodiment, the width (w) is no greater than 2.75 meters (e.g., about 9 feet). In at least one other embodiment, the width (w) is no greater than 1.83 meters (e.g., about 6 feet). In yet at least another embodiment, the width (w) ranges from 0.3 meters (e.g., about 1 foot) to 1.2 meters (e.g., about 4 feet). In at least one embodiment, the thickness (t) is no greater than 15 centimeters (e.g., about 5.9 inches). In at least one other embodiment, the thickness (t) is no greater than 9 centimeters (e.g., about 3.5 inches). In yet at least another embodiment, the thickness (t) ranges from 15 centimeters (e.g., about 5.9 inches) to 6 centimeters (e.g., about 2.4 inches).

In at least the embodiment of FIG. 2, the circlet 210 of FIG. 2 is a barrel slip. For example, the barrel slip may include angled surfaces 220 positioned along its inside diameter ($d_i$). In at least the embodiment of FIG. 2, the angled surfaces 220 are configured to engage one or more associated wedges of a sealing/anchoring tool, for example to move the circlet 210 between the radially reduced state (e.g., as shown) and the radially enlarged state.

The sealing/anchoring element 200 of FIG. 2 additionally includes one or more geometric features 230 in the circlet 210, which allow the circlet 210 to elasto/plastically deform when moved from the radially reduced state to a radially enlarged state. In the illustrated embodiment, the one or more geometric features 230 are two or more geometric alternating cuts that allow the circlet 210 to elastically deform when moved from the radially reduced state to a radially enlarged state. In at least one embodiment, the two or more geometric alternating cuts are located in the wall thickness (t) and spaced around a circumference of the circlet 210. In the illustrated embodiment, the two or more geometric alternating cuts are a plurality of axial cuts located in the wall thickness (t). The phrase "axial cuts," as used herein, means that the largest dimension of the two or more geometric alternating cuts are generally aligned with a central axis of the sealing/anchoring element 200, as opposed to generally perpendicular with the central axis of the sealing/anchoring element 200.

Figure 3:
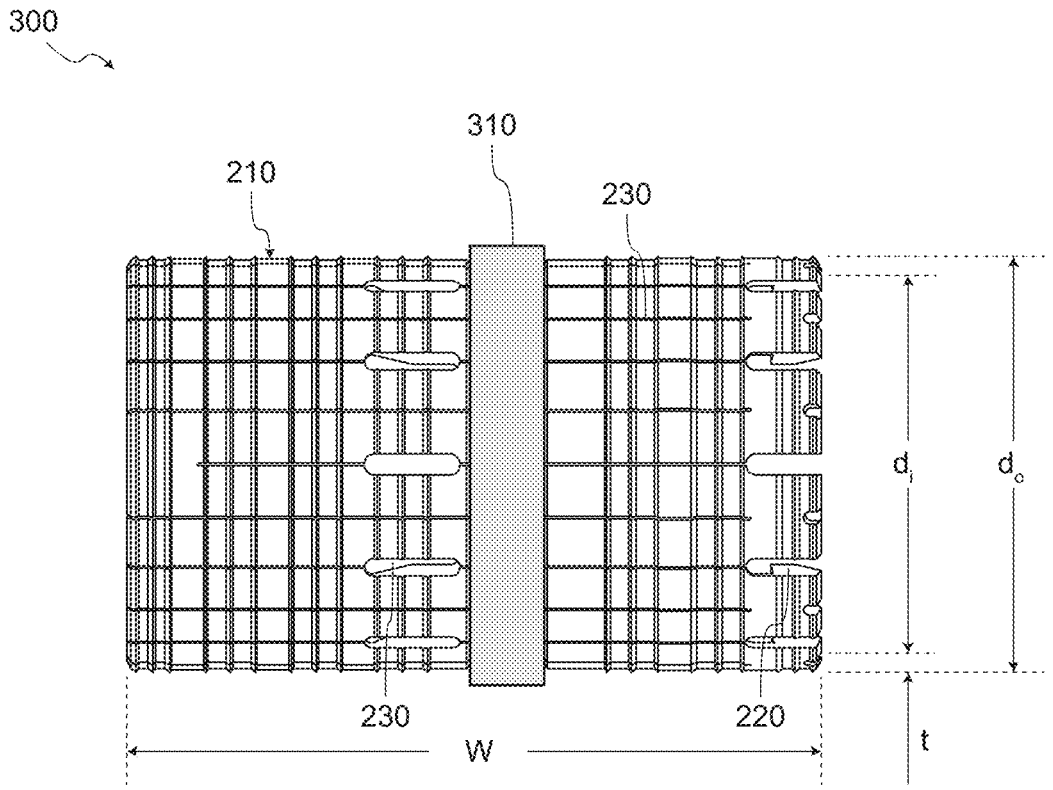
FIG. 3 illustrates one embodiment of a sealing/anchoring element designed, manufactured and operated according to an alternative embodiment of the disclosure.
Figure 4:
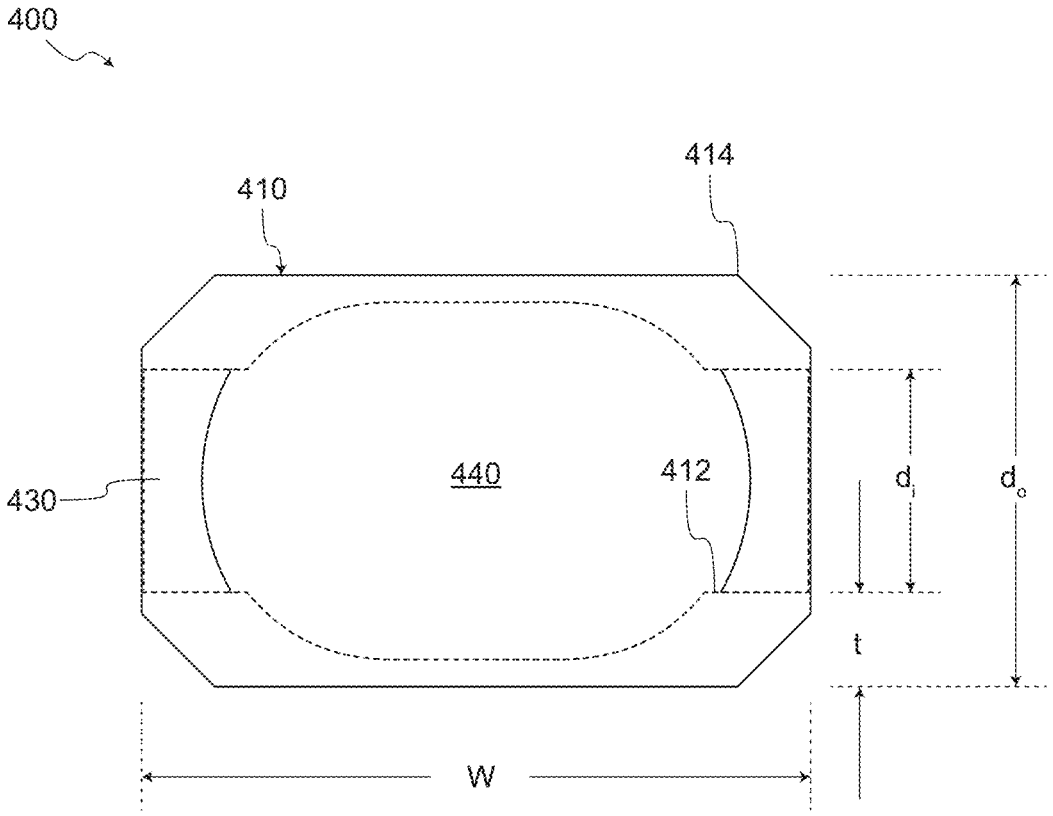
FIG. 4 illustrates one embodiment of a sealing/anchoring element designed, manufactured and operated according to an alternative embodiment of the disclosure.

Turning to FIG. 3, illustrated is one embodiment of a sealing/anchoring element 300 designed, manufactured and operated according to an alternative embodiment of the disclosure. The sealing/anchoring element 300 is similar in certain respects to the sealing/anchoring element 200. Accordingly, like reference identifiers have been used to indicate similar, if not identical, features. The sealing/anchoring element 300 differs, for the most part, from the sealing/anchoring element 200, in that the sealing/anchoring element 300 employs a ring of material 310 fully encircling at least a portion of the outside surface of the circlet 210. In at least one embodiment, the ring of material 310 is a thermoplastic ring of material. For example, the ring of material 310 (e.g., the thermoplastic ring of material) could have the benefit of holding the circlet 210 together during the run-in-hole state, but then stretch with the circlet 210 as it moves from the radially reduced state to the radially enlarged state. Additionally, the ring of material 310 may enhance the seal of the sealing/anchoring element 300 during the setting process. Examples of materials that can be part of the ring of material 310 include acrylic, ABS, nylon, PLA, polybenzimidazole, polycarbonate, polyether sulfone, polyoxymethylene, polyetherether ketone, polyetherimide, polyethylene, polyphenylene oxide, polyphenylene sulfide, polypropylene, polystyre, polyvinyl chloride, polyvidnylidene fluoride, polytetrafluoroethylene. In some examples, the thermoplastic material is mixed with a thermoset polymer, such as a thermoplastic polyurethane Turning to FIG. 4, illustrated is one embodiment of a sealing/anchoring element 400 designed, manufactured and operated according to an alternative embodiment of the disclosure. The sealing/anchoring element 400, in the illustrated embodiment comprises a circlet 410 having an inside surface 412 with an inside diameter ($d_i$), an outside surface 414 with an outside diameter ($d_o$), a width (w), and a wall thickness (t). The circlet 410, in the illustrated embodiment, additionally includes one or more geometric features that allow it to elasto/plastically deform when moved from a radially reduced state to a radially enlarged state. Further to the embodiment of FIG. 4, the circlet 410 comprises an expandable metal configured to expand in response to hydrolysis, such as discussed in the paragraphs above.

In the illustrated embodiment of FIG. 4, the circlet 410 is a football shaped member having an opening 430 extending therethrough and a geometric larger area 440 of material removed from a center thereof. In the illustrated embodiment, the geometric larger area 440 of material removed from the center is at least one geometric feature that allow the circlet 410 to elasto/plastically deform when moved from a radially reduced state to a radially enlarged state. In at least this embodiment, the opening 430 is configured to rest upon a mandrel extending entirely therethrough.

The circlet 410, in one or more embodiments, entirely comprises the expandable metal configured to expand in response to hydrolysis. In other embodiments, only a portion of the circlet 410 comprises the expandable metal. For example, in certain embodiments, an interior portion of the circlet 410 could comprise another material that does not expand in response to hydrolysis, such as steel, and an outer portion (e.g., radial cap) of the circlet 410 could comprise the expandable material. In other embodiments, an interior portion of the circlet 410 could comprise expandable metal, and an outer portion (e.g., radial cap) of the circlet 410 could comprise another material that does not expand in response to hydrolysis, such as a polymer.

Figure 5:
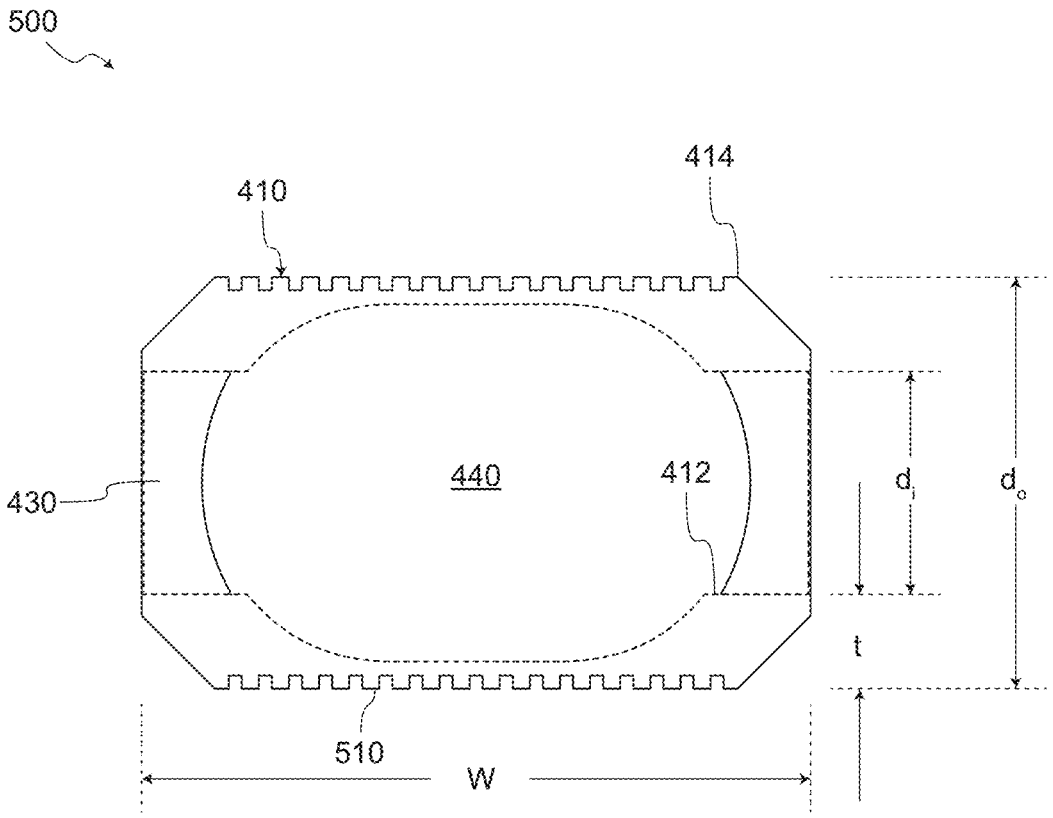
FIG. 5 illustrates one embodiment of a sealing/anchoring element designed, manufactured and operated according to an alternative embodiment of the disclosure.

Turning to FIG. 5, illustrated is one embodiment of a sealing/anchoring element 500 designed, manufactured and operated according to an alternative embodiment of the disclosure. The sealing/anchoring element 500 is similar in certain respects to the sealing/anchoring element 400. Accordingly, like reference identifiers have been used to indicate similar, if not identical, features. The sealing/anchoring element 500 differs, for the most part, from the sealing/anchoring element 400, in that the sealing/anchoring element 500 employs a plurality of teeth 510 located around at least a portion of the outside surface 414. In at least one embodiment, the plurality of teeth 510 help the circlet 410 anchor into a surface when the circlet 410 is moved from the radially reduced state to a radially enlarged state.

The plurality of teeth 510, in at least one embodiment, comprise the expandable metal. In one or more embodiments, the remainder of the circlet 410 also comprises the expandable metal, or alternatively comprises a non-expandable metal. In yet other embodiments, the plurality of teeth 510 comprise a non-expandable metal, such as steel, whereas another portion of the circlet 410 or a remaining entirety of the circlet 410 comprises the expandable metal.

Figure 6A:
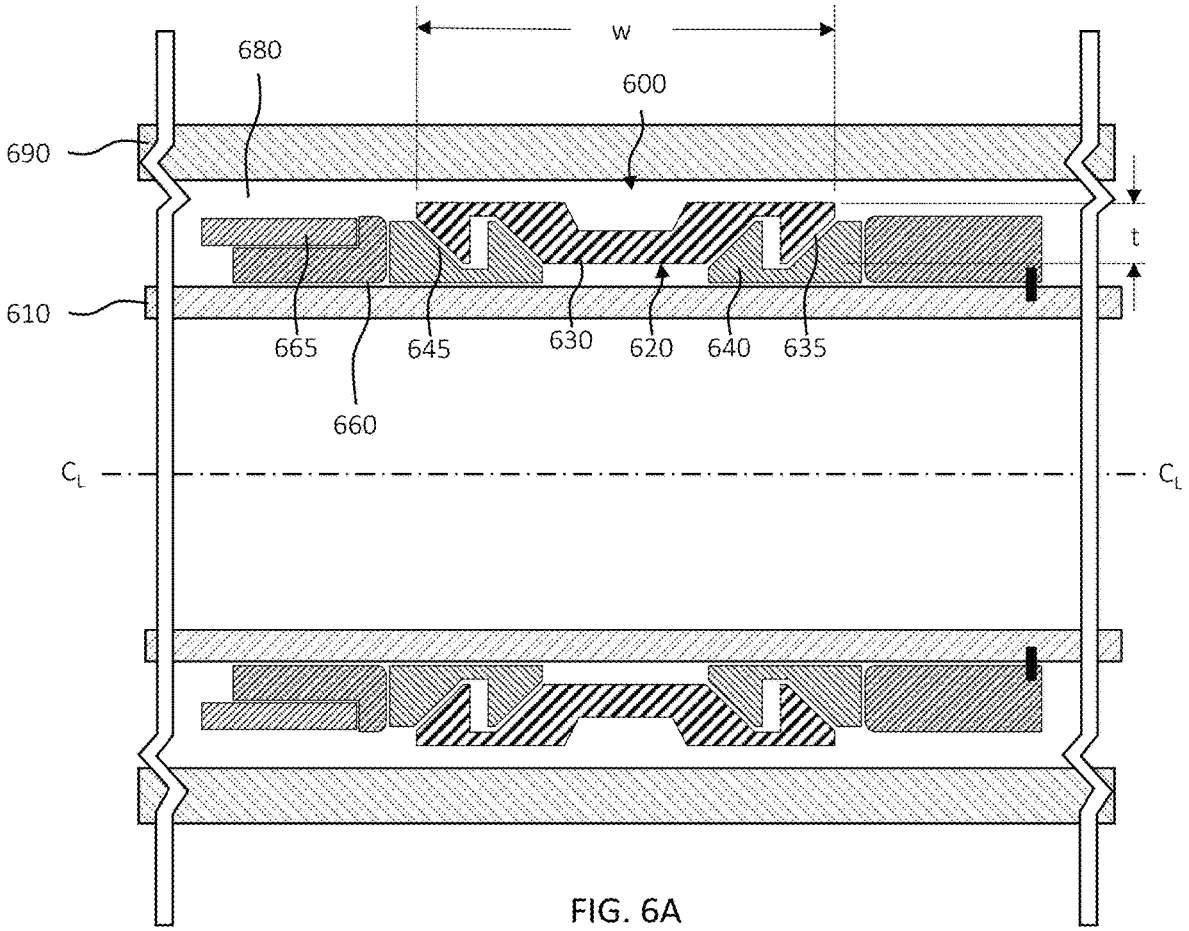
FIGS. 6A through 6C depict various different deployment states for a sealing/anchoring tool designed, manufactured and operated according to one embodiment of the disclosure.
Figure 6B:
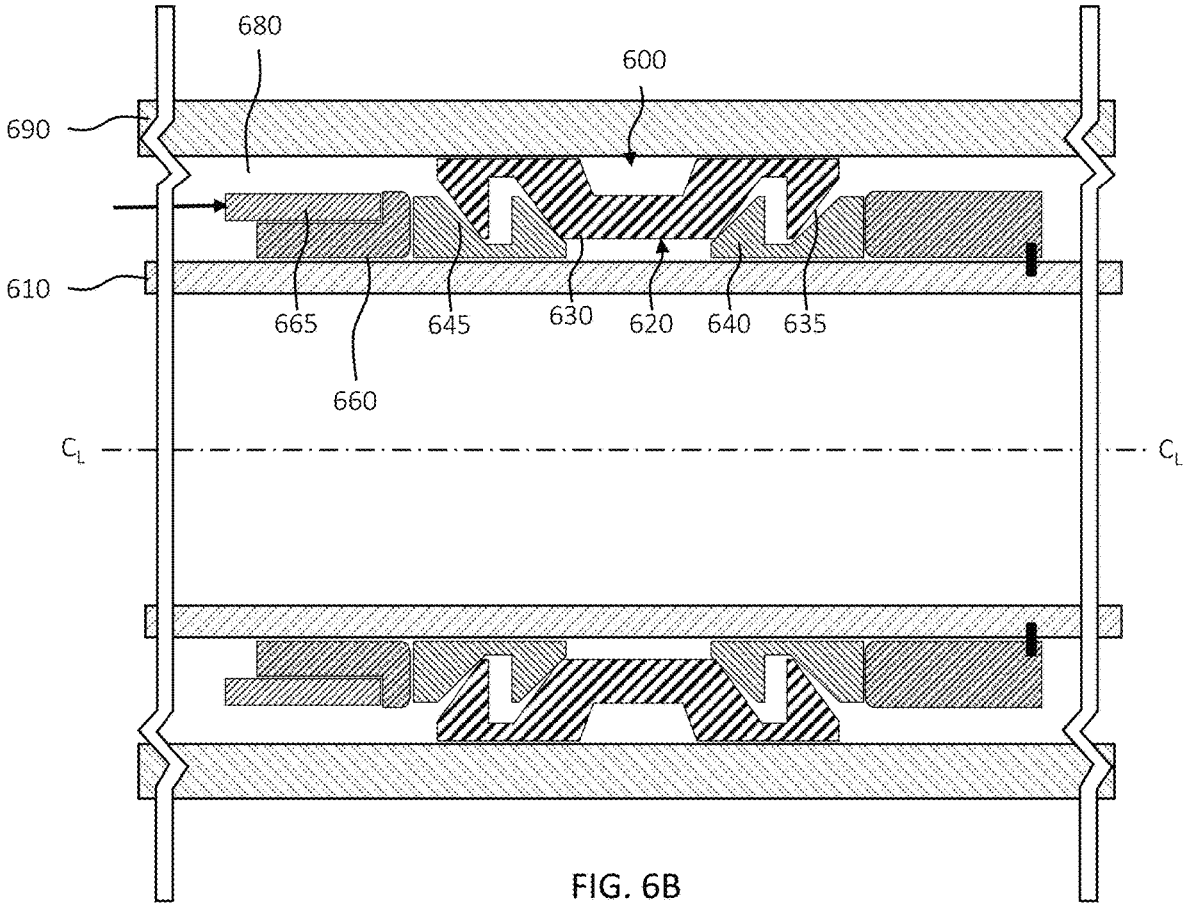
Figure 6C:
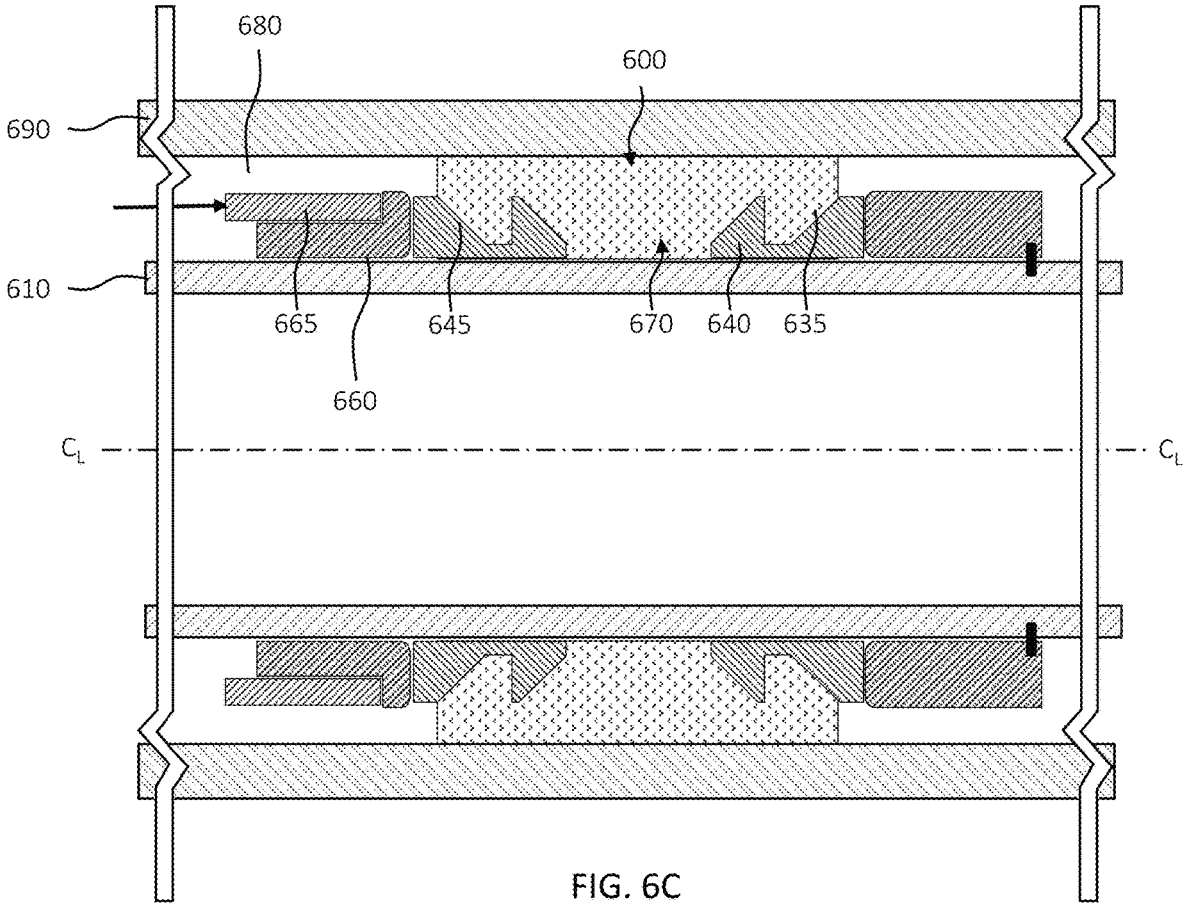

Turning now to FIGS. 6A through 6C, illustrated are various different deployment states for a sealing/anchoring tool 600 designed, manufactured and operated according to one aspect of the disclosure. FIG. 6A illustrates the sealing/anchoring tool 600 in a run-in-hole state, and thus its sealing/anchoring element is in the radially reduced state, and furthermore the expandable metal has not been subjected to reactive fluid to begin hydrolysis. In contrast, FIG. 6B illustrates the sealing/anchoring tool 600 with its sealing/anchoring element in the radially enlarged state, but again the expandable metal has not been subjected to reactive fluid to begin hydrolysis. In contrast, FIG. 6C illustrates the sealing/anchoring tool 600 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 600, in the illustrated embodiment of FIGS. 6A through 6C, includes a mandrel 610. The mandrel 610, in the illustrated embodiment, is centered about a centerline ($C_L$). The sealing/anchoring tool 600, in at least the embodiment of FIGS. 6A through 6C, is located in a bore 690 positioned around the mandrel 610. The bore 690, in at least one embodiment, is exposed wellbore. The bore 690, in at least one other embodiment, is a tubular positioned within a wellbore, such as a casing, production tubing, etc. In accordance with one aspect of the disclosure, the mandrel 610 and the bore 690 form an annulus 680. In one or more embodiments of the disclosure, the sealing/anchoring tool 600 is a frac plug or production packer, among other tools, and thus may provide sealing, anchoring, or both sealing and anchoring.

In accordance with one embodiment of the disclosure, the sealing/anchoring tool 600 includes a sealing/anchoring element 620 positioned about the mandrel 610. In at least one embodiment, the sealing/anchoring element 620 includes a circlet 630. The circlet 630, as discussed above, may include an inside surface having an inside diameter ($d_i$), an outside surface having an outside diameter ($d_o$), a width (w), and a wall thickness (t). Furthermore, at least a portion of the circlet 630 may comprise a metal configured to expand in response to hydrolysis.

The circlet 630 may additionally include one or more geometric features that allow it to elasto/plastically deform when moved from a radially reduced state to a radially enlarged state. In at least one embodiment, the one or more geometric features are one or more cuts (not shown) (e.g., axial cuts extending entirely through the wall thickness (t)) located in the wall thickness (t) and spaced around a circumference of the circlet 630. In yet another embodiment, the one or more geometric features are two or more geometric alternating cuts located in the wall thickness (t) and spaced around a circumference of the circlet 630. Nevertheless, other geometric features are within the scope of the disclosure.

The circlet 630 illustrated in FIGS. 6A through 6C is configured as a barrel slip structure, for example similar to that illustrated in FIG. 2. In the illustrated embodiment of FIGS. 6A through 6C, the circlet 630 additionally includes angled surfaces 635 positioned along its inside diameter ($d_i$). As will be detailed below, the angled surfaces 635 are configured to engage one or more associated wedges to move the circlet 630 between the radially reduced state and a radially enlarged state. Nevertheless, the barrel slip structure could employ different designs while remaining with the scope of the present disclosure.

The sealing/anchoring tool 600, in the illustrated embodiment, additionally includes the one or more associated wedges 640 (e.g., a first wedge and a second wedge located on opposing sides of the sealing/anchoring element 620). The one or more associated wedges 640, in one or more embodiments, are configured to axially slide along the mandrel 610 relative to the circlet 630 to move the circlet 630 from the radially reduced state to the radially enlarged state (e.g., the first and second wedges configured to axial slide along the mandrel relative to one another to move the circlet from the radially reduced state to the radially enlarged state, as if it were a frac plug). The one or more associated wedges 640, in the illustrated embodiment, include one or more associated angled surfaces 645. As is evident in the embodiment of FIGS. 6A through 6C, the one or more associated angled surface 645 are operable to engage with the opposing angled surfaces 635 of the circlet 630, and thus move the circlet 630 between the radially reduced state (e.g., as shown in FIG. 6A) and a radially enlarged state (e.g., as shown in FIGS. 6B and 6C).

The sealing/anchoring tool 600, in the illustrated embodiment, may additionally include one or more end rings 660 located on opposing sides of the one or more associated wedges 640. In the illustrated embodiment, one of the end rings 660 may be axially fixed relative to the mandrel 610 or the bore 690, and the other of the end rings 660 is allowed to axially move relative to the mandrel 610 or the bore 690, and thus move the circlet 630 between the radially reduced state (e.g., as shown in FIG. 6A) and a radially enlarged state (e.g., as shown in FIGS. 6B and 6C).

The sealing/anchoring tool 600, in one or more embodiments, may additionally include a piston structure 665 for axially moving the free end ring 660. Accordingly, the piston structure 665 may be used to move the circlet 630 between the radially reduced state (e.g., as shown in FIG. 6A) and a radially enlarged state (e.g., as shown in FIGS. 6B and 6C). The piston structure 665 may take on many different designs while remaining within the scope of the present disclosure.

With reference to FIG. 6A, the circlet 630 is again configured as the barrel slip structure and comprises a metal configured to expand in response to hydrolysis. The circlet 630 may comprise any of the expandable metals discussed above. The circlet 630 may have a variety of different shapes, sizes, etc. and remain within the scope of the disclosure. Moreover, different features of the circlet 630 may comprise the metal configured to expand in response to hydrolysis.

With reference to FIG. 6B, illustrated is the sealing/anchoring tool 600 of FIG. 6A after setting the sealing/anchoring element 620. In the illustrated embodiment of FIG. 6B, the sealing/anchoring element 620 is set by axially moving (e.g., by way of the piston 665) the end rings 660 relative to one another and thereby engaging the one or more associated angled surface 645 of the one or more wedges 640 with the opposing angled surfaces 635 of the circlet 630. Accordingly, the sealing/anchoring element 620 is moved between the radially reduced state (e.g., as shown in FIG. 6A) and the radially enlarged state shown in FIG. 6B. In at least one embodiment, the elasto/plastic deformation increases the outside diameter by at least 5 percent. In yet another embodiment, the elasto/plastic deformation increases the outside diameter by at least 20 percent, and in yet one other embodiment the elasto/plastic deformation increases the outside diameter by a range of 5 percent to 50 percent.

In the illustrated embodiment of FIG. 6B, the sealing/anchoring element 620 engages with the bore 690, thereby spanning the annulus 680. Further to the embodiment of FIG. 6B, the circlet 630 has been elasto/plastically deformed. Thus, in certain instances the circlet 630 has been elastically deformed, in certain other instances the circlet 630 has been plastically deformed, and in yet other embodiments the circlet 630 has been elastically and plastically deformed.

With reference to FIG. 6C, illustrated is the sealing/anchoring tool 600 of FIG. 6B after subjecting the sealing/anchoring element 620 to reactive fluid to form an expanded metal sealing/anchoring element 670, as discussed above. As disclosed above, the expanded metal sealing/anchoring element 670 may include residual unreacted metal. The reactive fluid may be any of the reactive fluid discussed above. In the illustrated embodiment of FIG. 6C, the expanded metal sealing/anchoring element 670 at least partially fills the annulus 680, and thereby act as a seal/anchor. For example, the expanded metal sealing/anchoring element 670 might act as a seal, with very little anchoring ability. In yet other embodiments, the expanded metal sealing/anchoring element 670 might act as an anchor, with very little sealing ability. In even yet other embodiments, the expanded metal sealing/anchoring element 670 might act as a highly suitable seal and anchor. It should be noted, that as the expanded metal sealing/anchoring element 670 remains in the radially enlarged state regardless of the force from the piston structure 665, certain embodiments may remove the force from the piston structure 665 after the expanded metal sealing/anchoring element 670 has been formed.

In certain embodiments, the time period for the hydration of the circlet 630 is different from the time period for setting the sealing/anchoring element 620. For example, the setting of the sealing/anchoring element 620 might create a quick, but weaker, seal/anchor for the sealing/anchoring tool 600, whereas the circlet 630 could take multiple hours to several days for the hydrolysis process to fully expand, but provide a strong seal/anchor for the sealing/anchoring tool 600.

While not shown, the sealing/anchoring tool 600, and more particularly the sealing/anchoring element 620 of the sealing/anchoring tool 600, may additionally include one or more additional sealing elements. For example, the one or more additional sealing elements could be located uphole or downhole of the sealing/anchoring element 620, and thus be used to fluidly seal the annulus 680. In many situations, the one or more additional sealing elements comprise elastomeric sealing elements that are located downhole of the sealing/anchoring element 620.

A sealing/anchoring tool, and related sealing/anchoring element, according to the present disclosure may provide higher technical ratings and/or may provide a lower cost alternative to existing sealing/anchoring elements contained of today's packers and frac plugs. A sealing/anchoring tool, and related sealing/anchoring element, employs a game changing material that gets away from the issues found in conventional elastomeric devices, such as: extreme temperature limits, low temperature sealing limits, swabbing while running, extrusion over time, conforming to irregular shapes, etc.

Figure 7A:
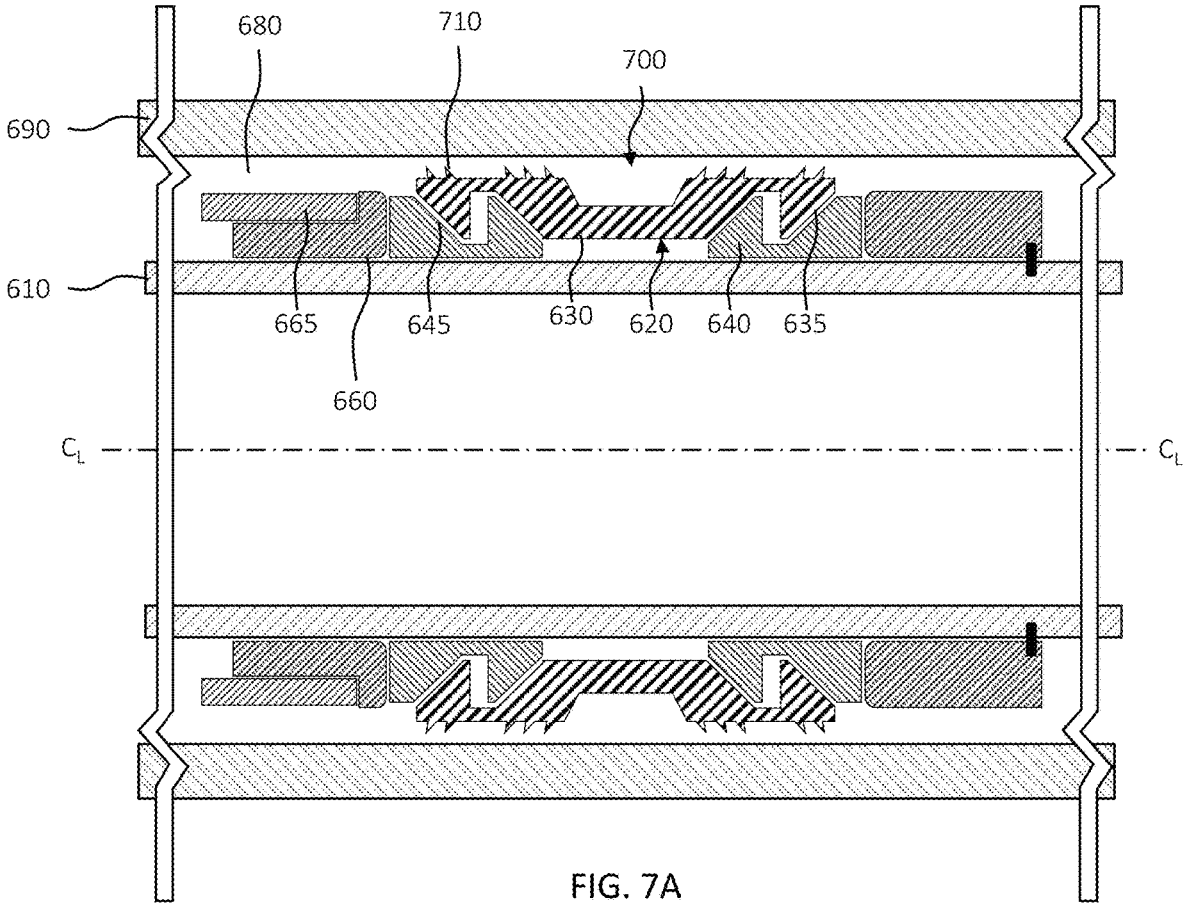
FIGS. 7A through 7C depict various different deployment states for a sealing/anchoring tool designed, manufactured and operated according to an alternative embodiment of the disclosure.
Figure 7B:
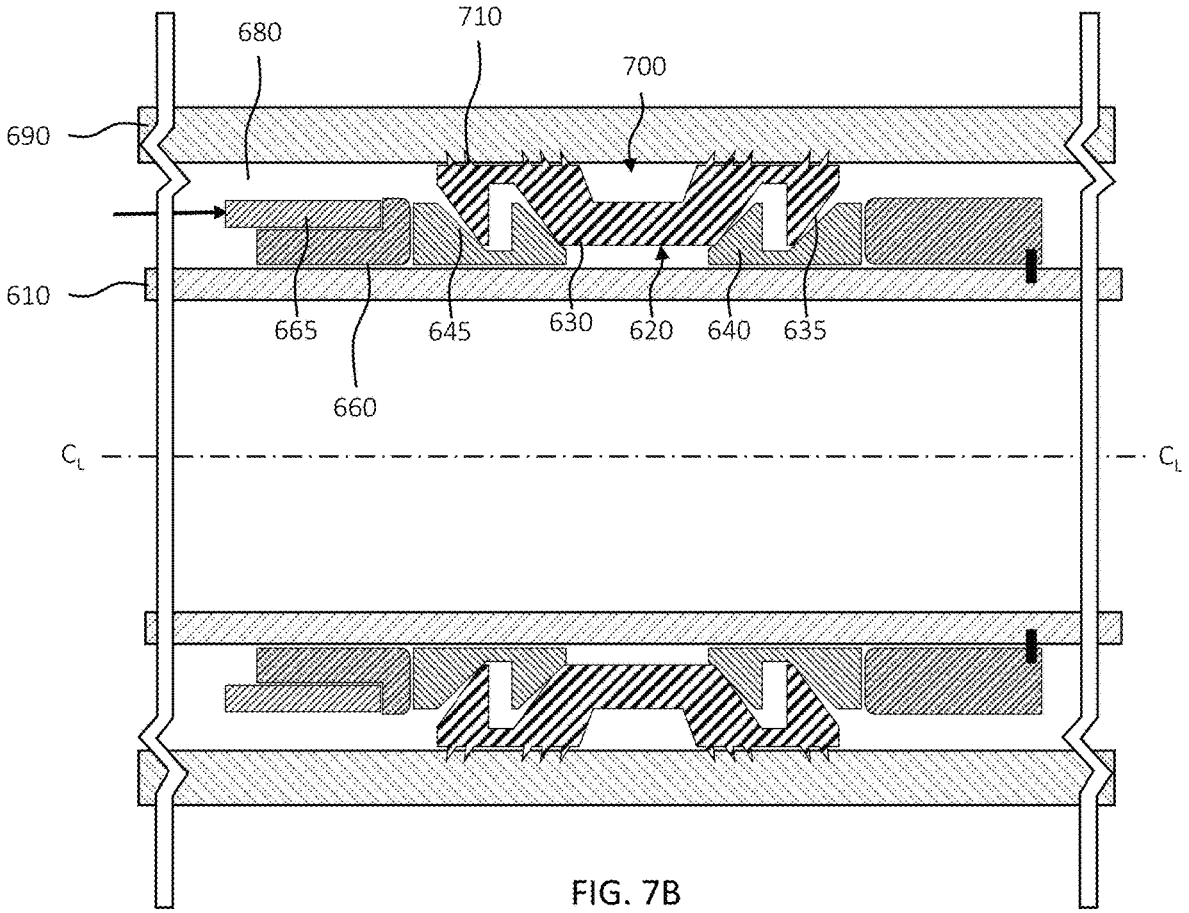
Figure 7C:
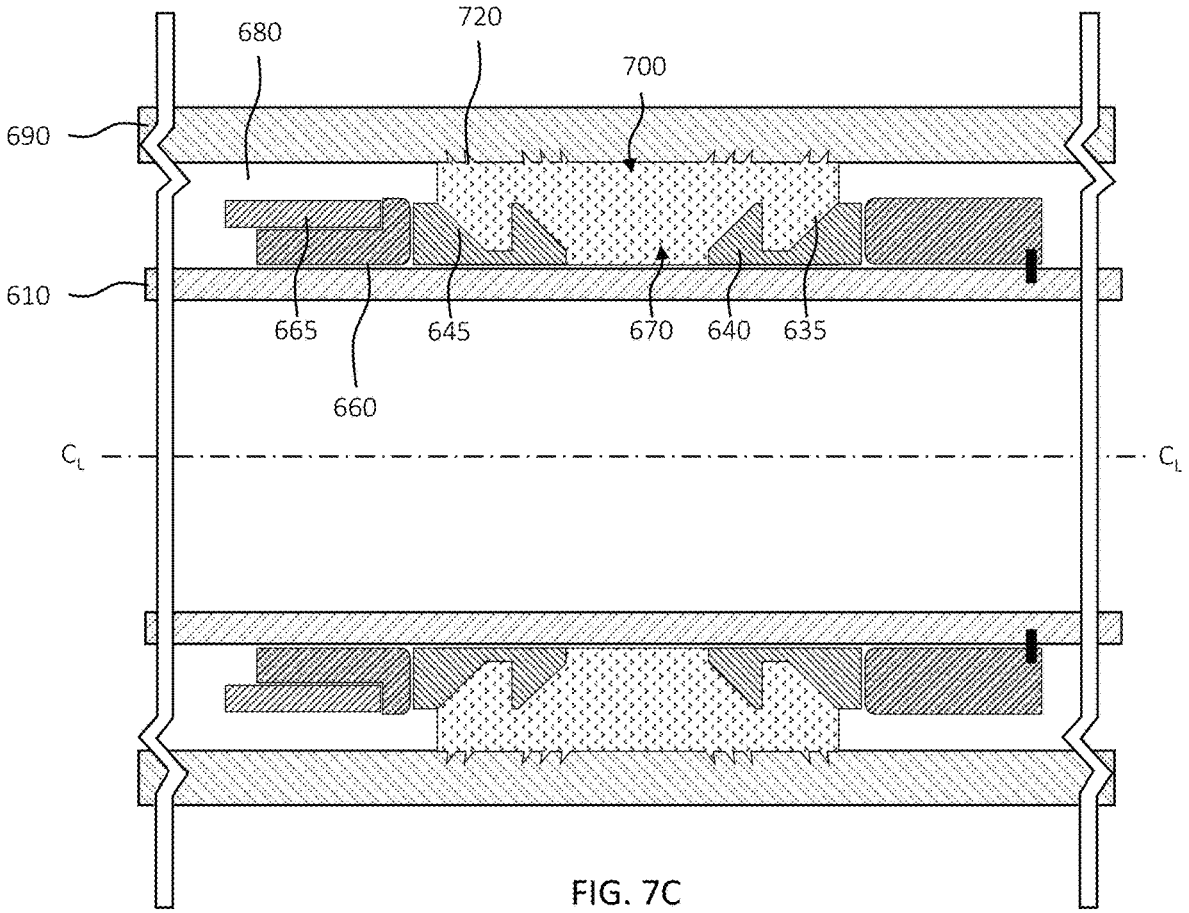

Turning to FIGS. 7A through 7C, depicted are various different deployment states for a sealing/anchoring tool 700 designed, manufactured and operated according to an alternative embodiment of the disclosure. FIG. 7A illustrates the sealing/anchoring tool 700 in a run-in-hole state, and thus its sealing/anchoring element is in the radially reduced state, and furthermore the expandable metal has not been subjected to reactive fluid to begin hydrolysis. In contrast, FIG. 7B illustrates the sealing/anchoring tool 700 with its sealing/anchoring element in the radially enlarged state, but again the expandable metal has not been subjected to reactive fluid to begin hydrolysis. In contrast, FIG. 7C illustrates the sealing/anchoring tool 700 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 700 is similar in certain respects to the sealing/anchoring tool 600. Accordingly, like reference numbers have been used to indicate similar, if not identical, features. The sealing/anchoring tool 700 differs, for the most part, from the sealing/anchoring tool 600, in that the sealing/anchoring tool 700 employs a plurality of teeth 710 located around at least a portion of the outside surface of its circlet 630. In at least one embodiment, the plurality of teeth 710 comprise the metal configured to expand in response to hydrolysis, wherein a remainder of the circlet 630 does not comprise the metal configured to expand in response to hydrolysis. In yet other embodiments, the plurality of teeth 710 do not comprise a metal configured to expand in response to hydrolysis, but other features of the circlet 630 do comprise a metal configured to expand in response to hydrolysis. In yet another embodiment, the circlet 630 and the plurality of teeth 710 comprise the metal configured to expand in response to hydrolysis. What may result in one or more embodiments, after hydrolysis, is the expanded metal sealing/anchoring element 670 including a plurality of teeth 720, as shown in FIG. 7C.

Figure 8A:
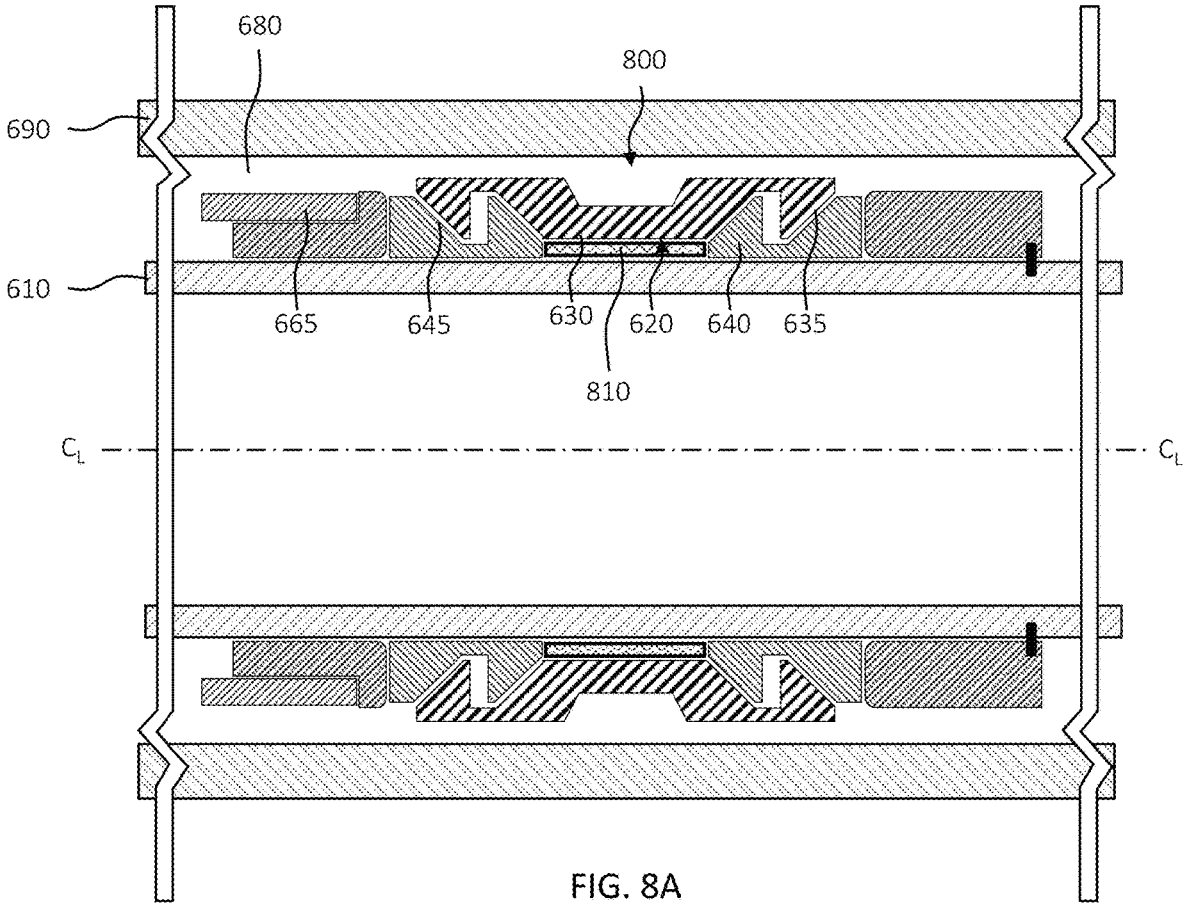
FIGS. 8A through 8C depict various different deployment states for a sealing/anchoring tool designed, manufactured and operated according to an alternative embodiment of the disclosure.
Figure 8B:
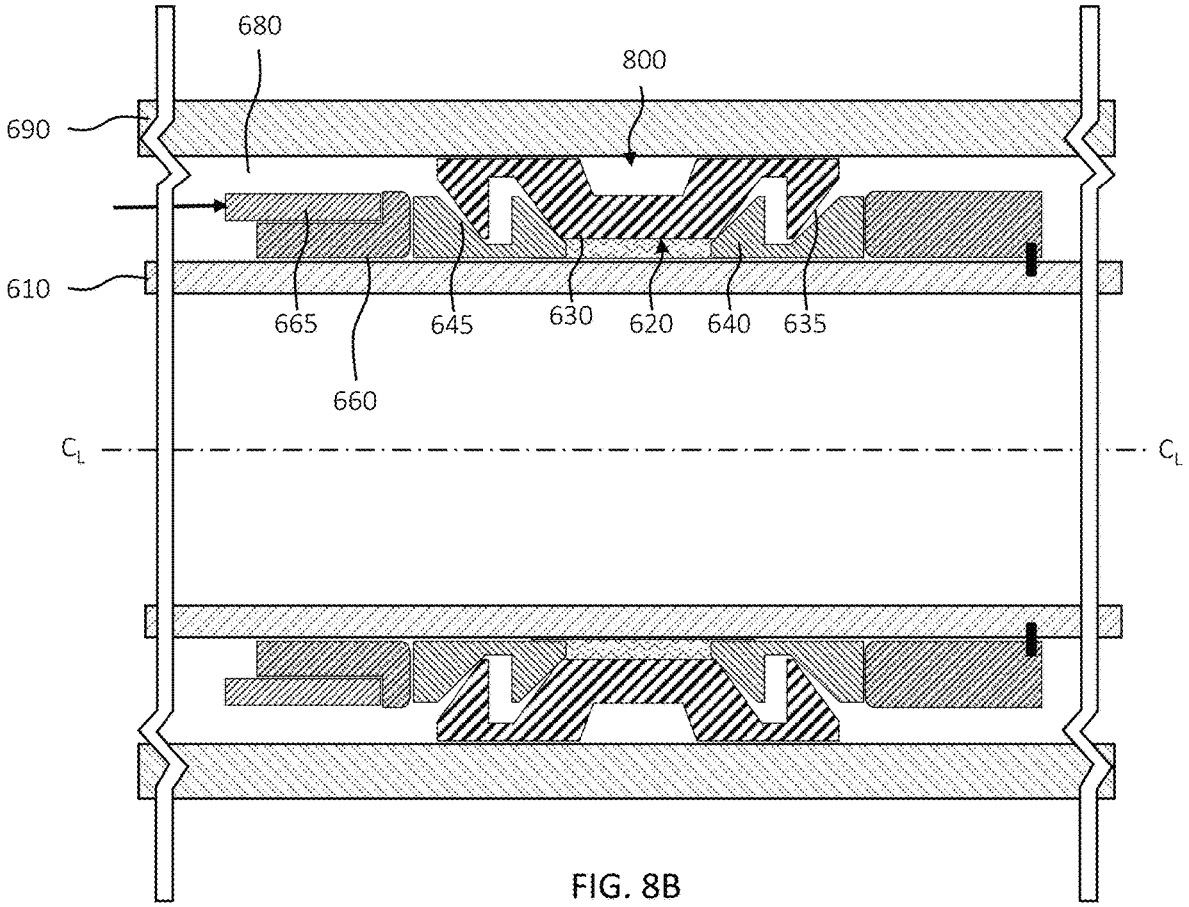
Figure 8C:
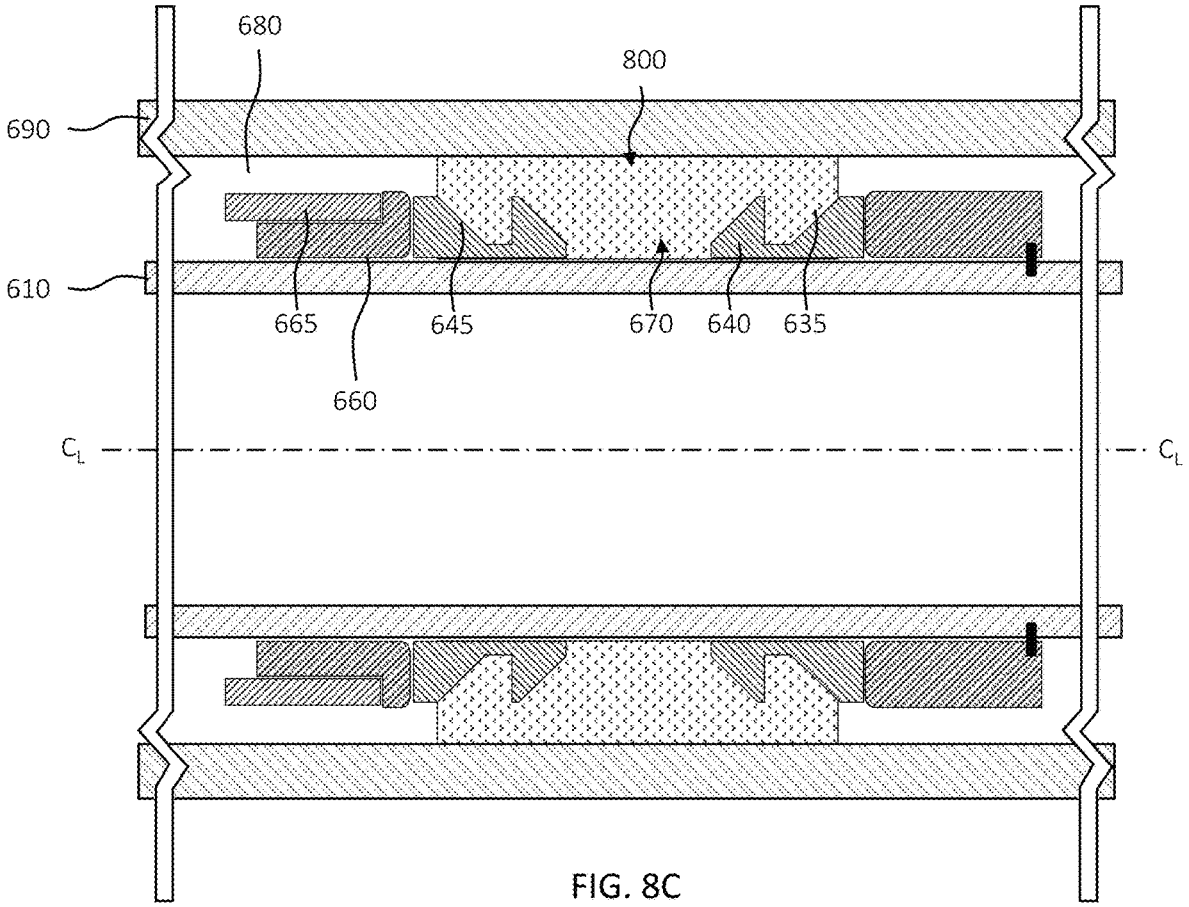

Turning to FIGS. 8A through 8C, depicted are various different deployment states for a sealing/anchoring tool 800 designed, manufactured and operated according to an alternative embodiment of the disclosure. FIG. 8A illustrates the sealing/anchoring tool 800 in a run-in-hole state, and thus its sealing/anchoring element is in the radially reduced state, and furthermore the expandable metal has not been subjected to reactive fluid to begin hydrolysis. In contrast, FIG. 8B illustrates the sealing/anchoring tool 800 with its sealing/anchoring element in the radially enlarged state, but again the expandable metal has not been subjected to reactive fluid to begin hydrolysis. In contrast, FIG. 8C illustrates the sealing/anchoring tool 800 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 800 is similar in certain respects to the sealing/anchoring tool 600. Accordingly, like reference numbers have been used to indicate similar, if not identical, features. The sealing/anchoring tool 800 differs, for the most part, from the sealing/anchoring tool 600, in that the sealing/anchoring tool 800 employs a self-contained (e.g., frangible) body of reactive fluid 810. For example, the self-contained body of reactive fluid 810 could be positioned between the wedges 640. Thus, when the wedges 640 axially slide relative to one another to move the circlet 630 from the radially reduced state to the radially enlarged state, the self-contained body of reactive fluid 810 bursts, thereby subjecting the circlet 630 to the reactive fluid. What may result in one or more embodiments, after the bursting of the self-contained body of reactive fluid 810 and after hydrolysis, is the expanded metal sealing/anchoring element 670 shown in FIG. 8C.

Figure 9A:
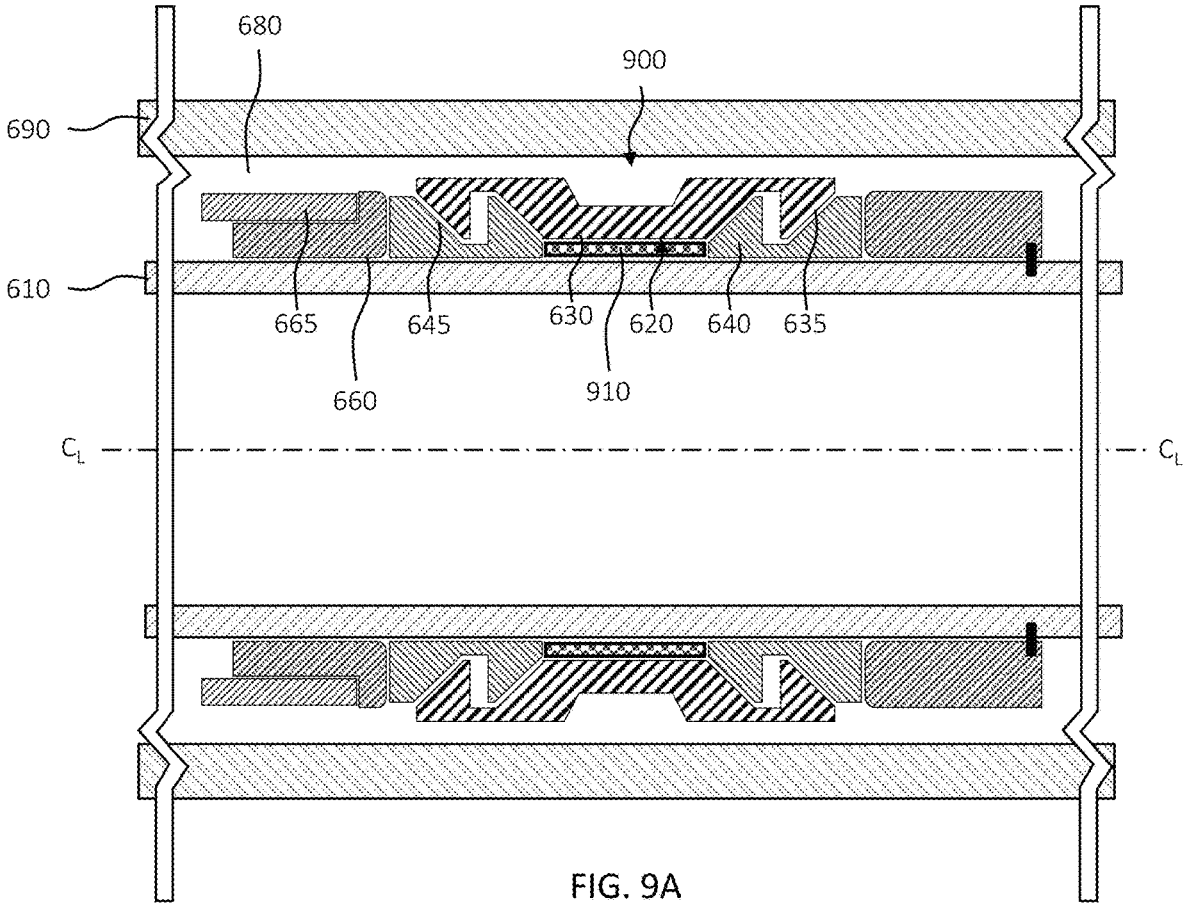
FIGS. 9A through 9C depict various different deployment states for a sealing/anchoring tool designed, manufactured and operated according to an alternative embodiment of the disclosure.
Figure 9B:
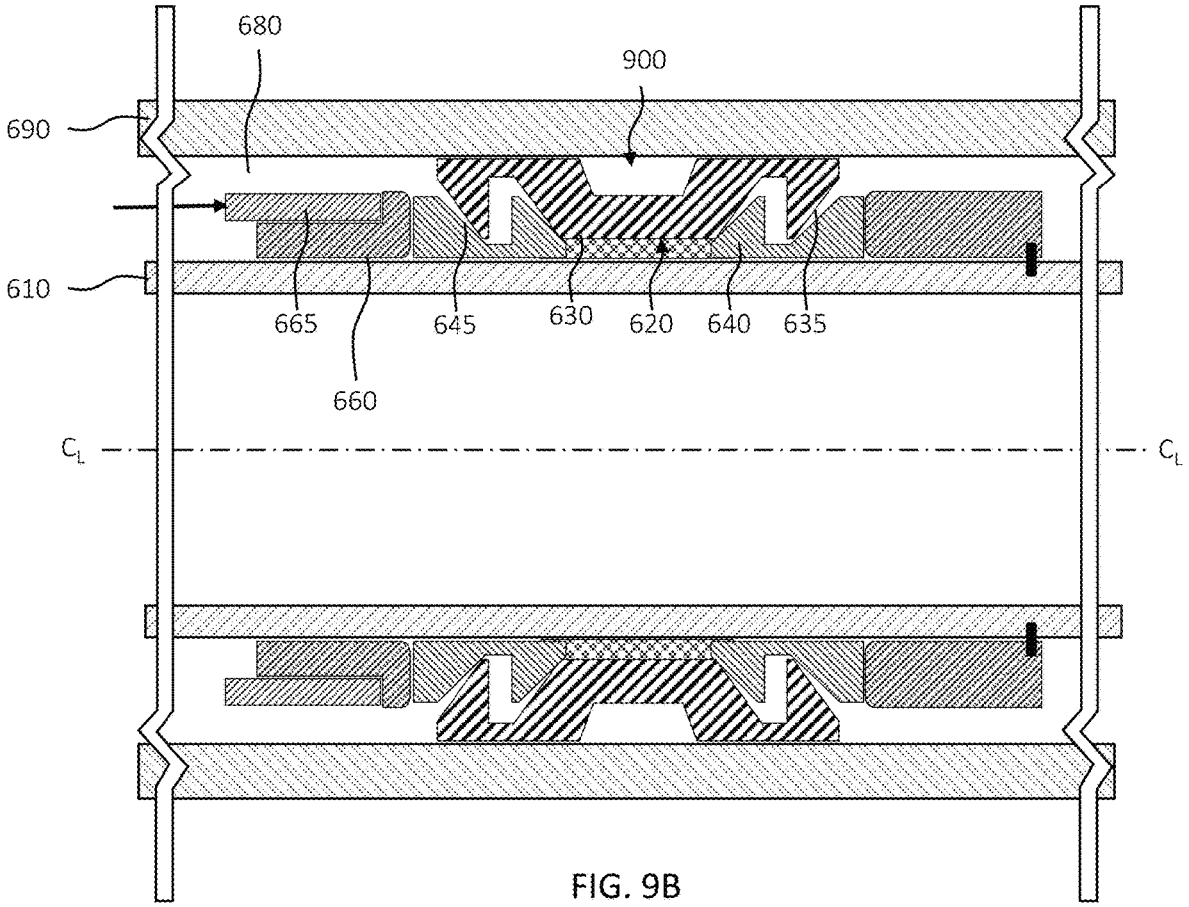
Figure 9C:
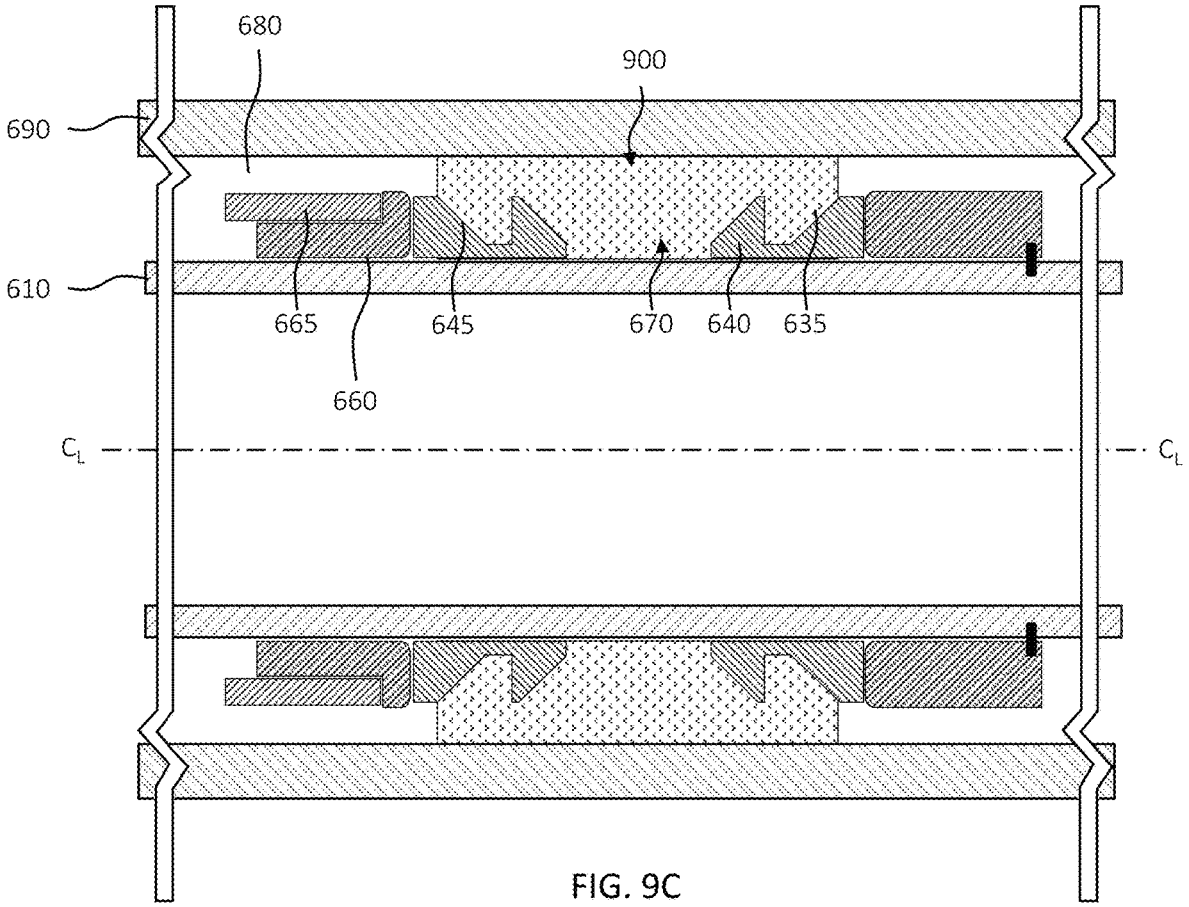

Turning to FIGS. 9A through 9C, depicted are various different deployment states for a sealing/anchoring tool 900 designed, manufactured and operated according to an alternative embodiment of the disclosure. FIG. 9A illustrates the sealing/anchoring tool 900 in a run-in-hole state, and thus its sealing/anchoring element is in the radially reduced state, and furthermore the expandable metal has not been subjected to reactive fluid to begin hydrolysis. In contrast, FIG. 9B illustrates the sealing/anchoring tool 900 with its sealing/anchoring element in the radially enlarged state, but again the expandable metal has not been subjected to reactive fluid to begin hydrolysis. In contrast, FIG. 9C illustrates the sealing/anchoring tool 900 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 900 is similar in certain respects to the sealing/anchoring tool 600. Accordingly, like reference numbers have been used to indicate similar, if not identical, features. The sealing/anchoring tool 900 differs, for the most part, from the sealing/anchoring tool 600, in that the sealing/anchoring tool 900 employs a self-contained (e.g., frangible) heat source 910. For example, the self-contained heat source 910 could be positioned between the wedges 640. Thus, when the wedges 640 axially slide relative to one another to move the circlet 630 from the radially reduced state to the radially enlarged state, the self-contained heat source 910 bursts, thereby subjecting the circlet 630 to elevated temperatures, which could be used to speed of the hydrolysis.

Those skilled in the art understand the various different materials that may be used for the self-contained heat source 910. For example, in at least one embodiment, the self-contained heat source 910 could comprise small particles of magnesium, aluminum, etc. that would react with water to form a hydroxide, the reaction creating the elevated temperatures. What may result in one or more embodiments, after the bursting of the self-contained heat source 910 and after hydrolysis, is the expanded metal sealing/anchoring element 670 shown in FIG. 9C.

Figure 10A:
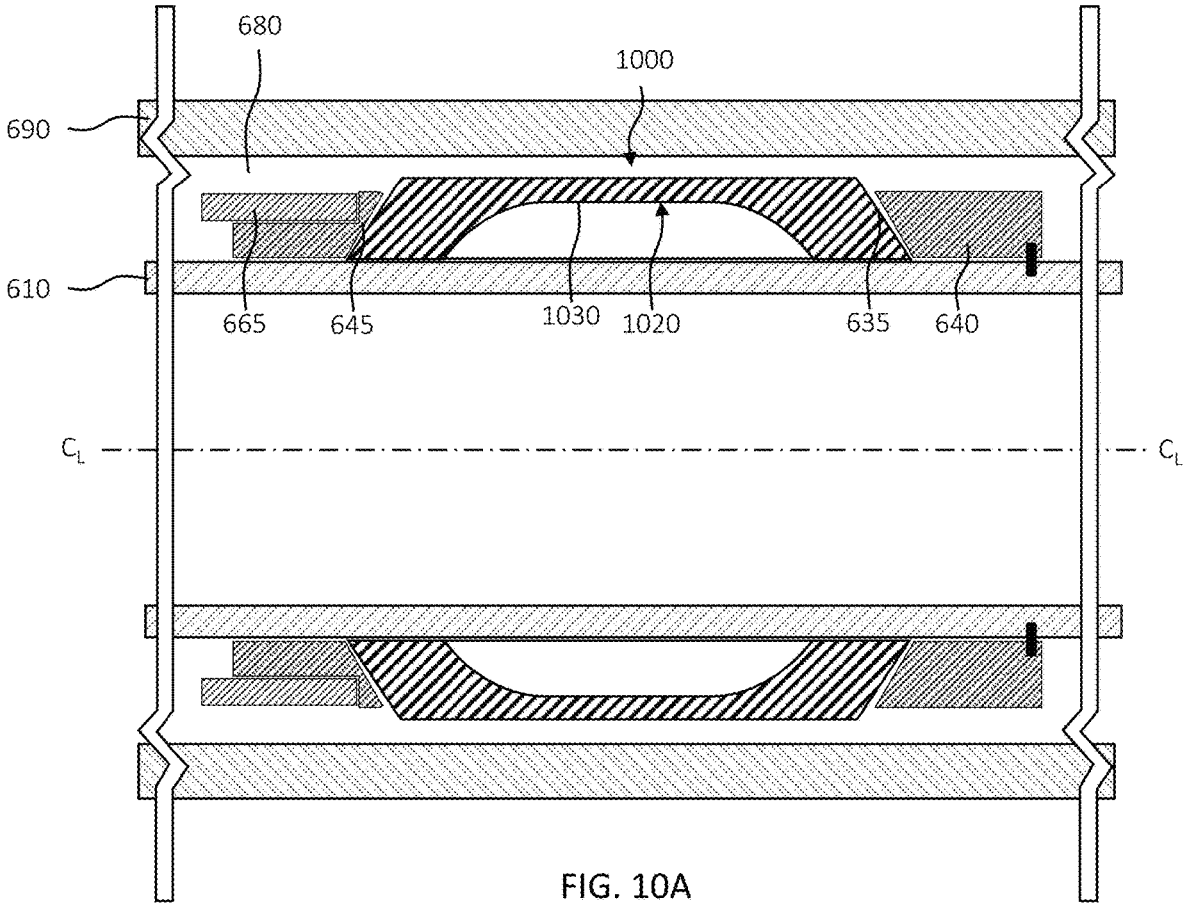
FIGS. 10A through 10C depict various different deployment states for a sealing/anchoring tool designed, manufactured and operated according to an alternative embodiment of the disclosure.
Figure 10B:
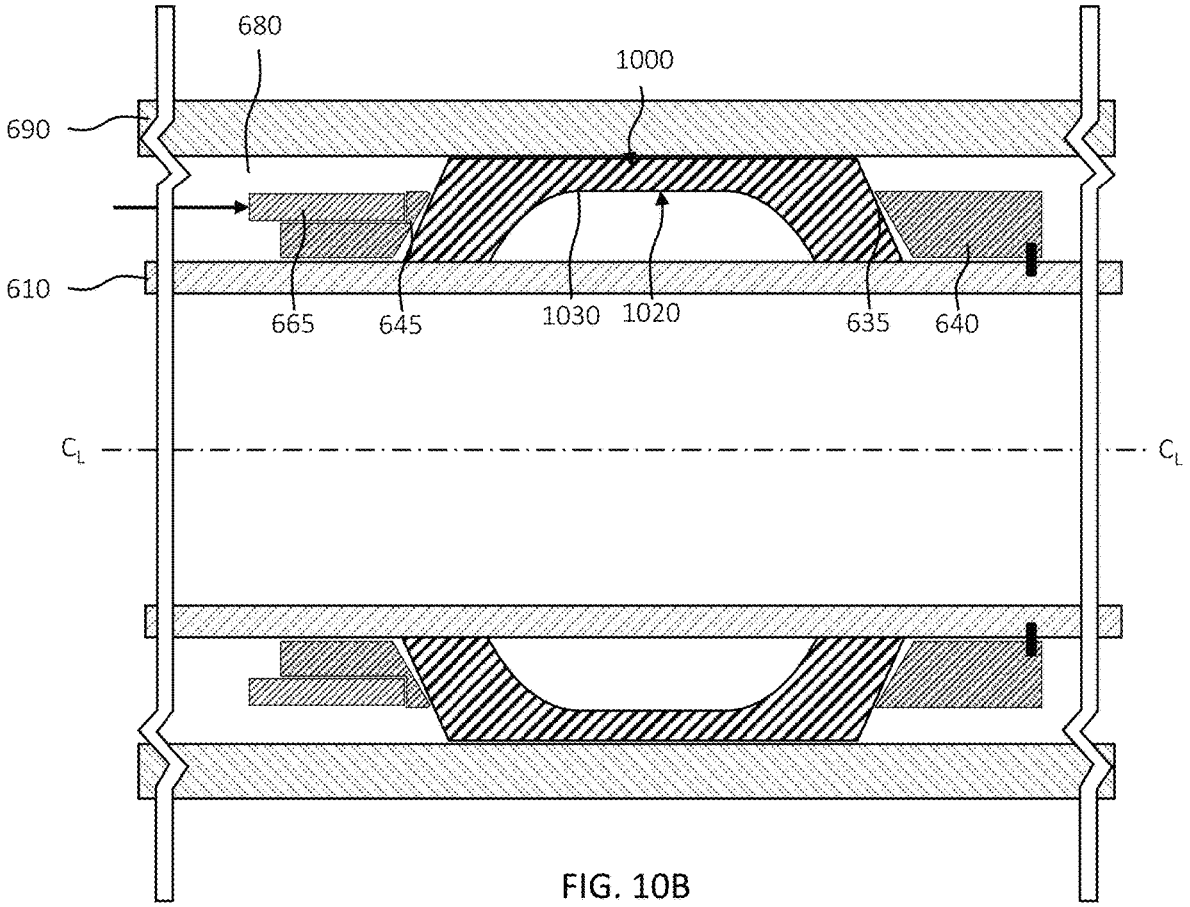
Figure 10C:
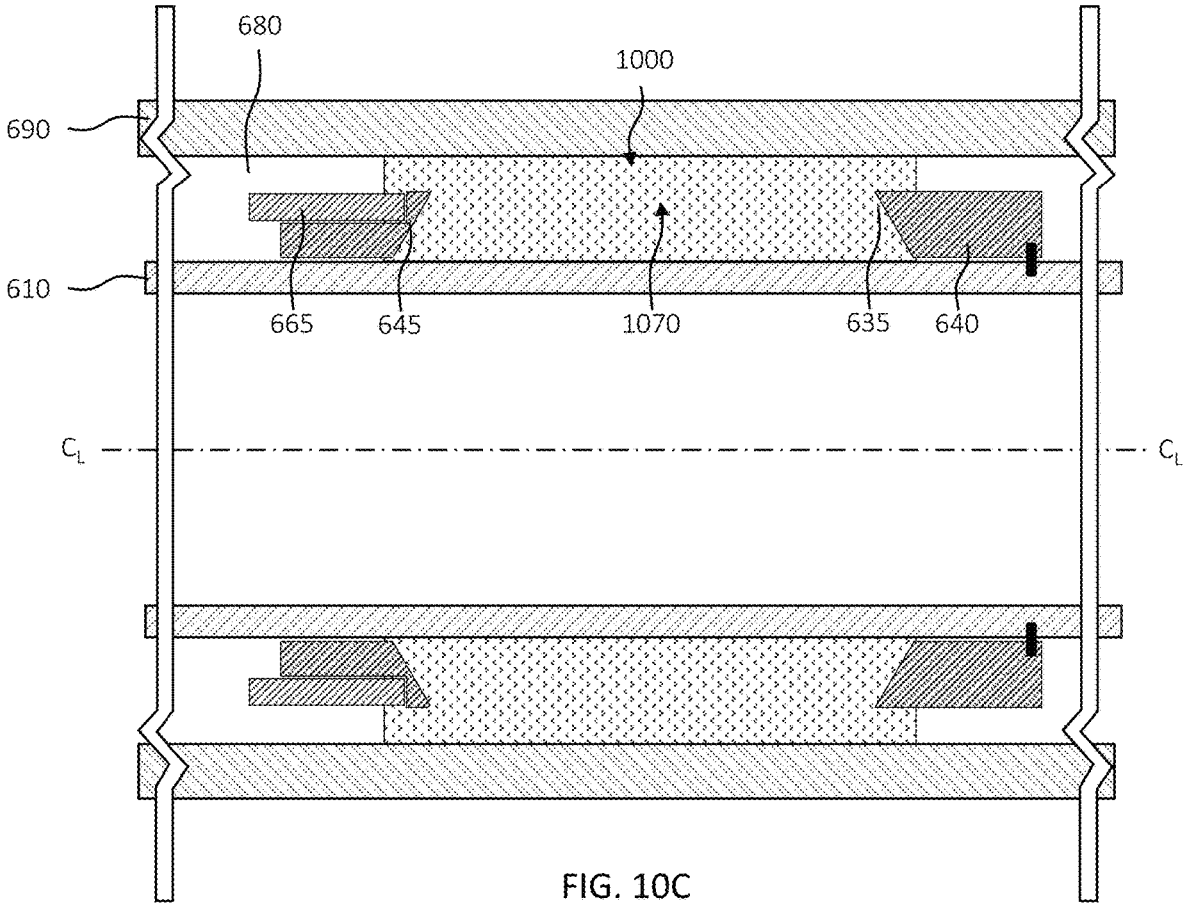

Turning to FIGS. 10A through 10C, depicted are various different deployment states for a sealing/anchoring tool 1000 designed, manufactured and operated according to an alternative embodiment of the disclosure. FIG. 10A illustrates the sealing/anchoring tool 1000 in a run-in-hole state, and thus its sealing/anchoring element is in the radially reduced state, and furthermore the expandable metal has not been subjected to reactive fluid to begin hydrolysis. In contrast, FIG. 10B illustrates the sealing/anchoring tool 1000 with its sealing/anchoring element in the radially enlarged state, but again the expandable metal has not been subjected to reactive fluid to begin hydrolysis. In contrast, FIG. 10C illustrates the sealing/anchoring tool 1000 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1000 is similar in certain respects to the sealing/anchoring tool 600. Accordingly, like reference numbers have been used to indicate similar, if not identical, features. The sealing/anchoring tool 1000 differs, for the most part, from the sealing/anchoring tool 600, in that the sealing/anchoring tool 1000 employs a sealing/anchoring element 1020 that employs a football shaped circlet 1030. In at least one embodiment, the football shaped circlet 1030 is similar in many respects to the circlet 410 of FIG. 4. What may result in one or more embodiments, after the hydrolysis, is the expanded metal sealing/anchoring element 1070 shown in FIG. 10C.

Figure 11A:
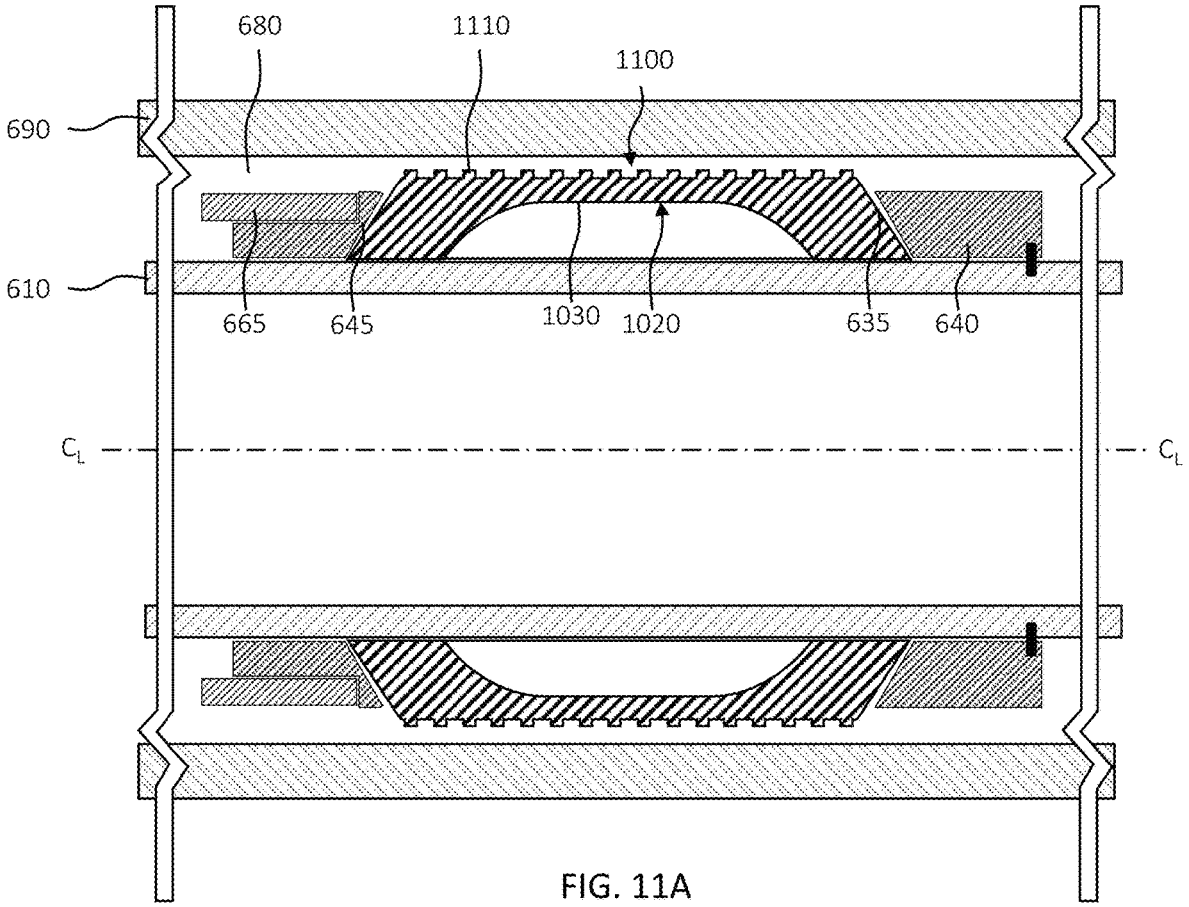
FIGS. 11A through 11C depict various different deployment states for a sealing/anchoring tool designed, manufactured and operated according to an alternative embodiment of the disclosure.
Figure 11B:
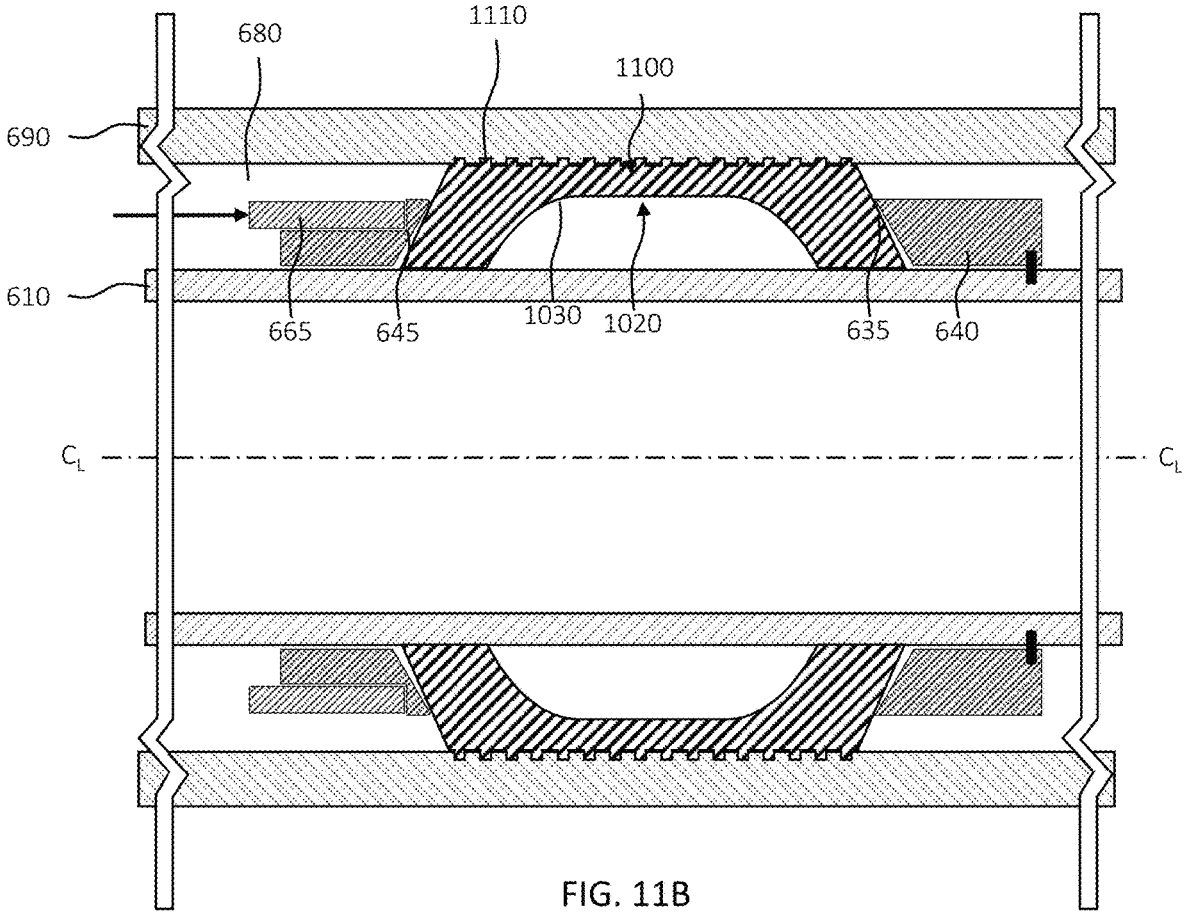
Figure 11C:
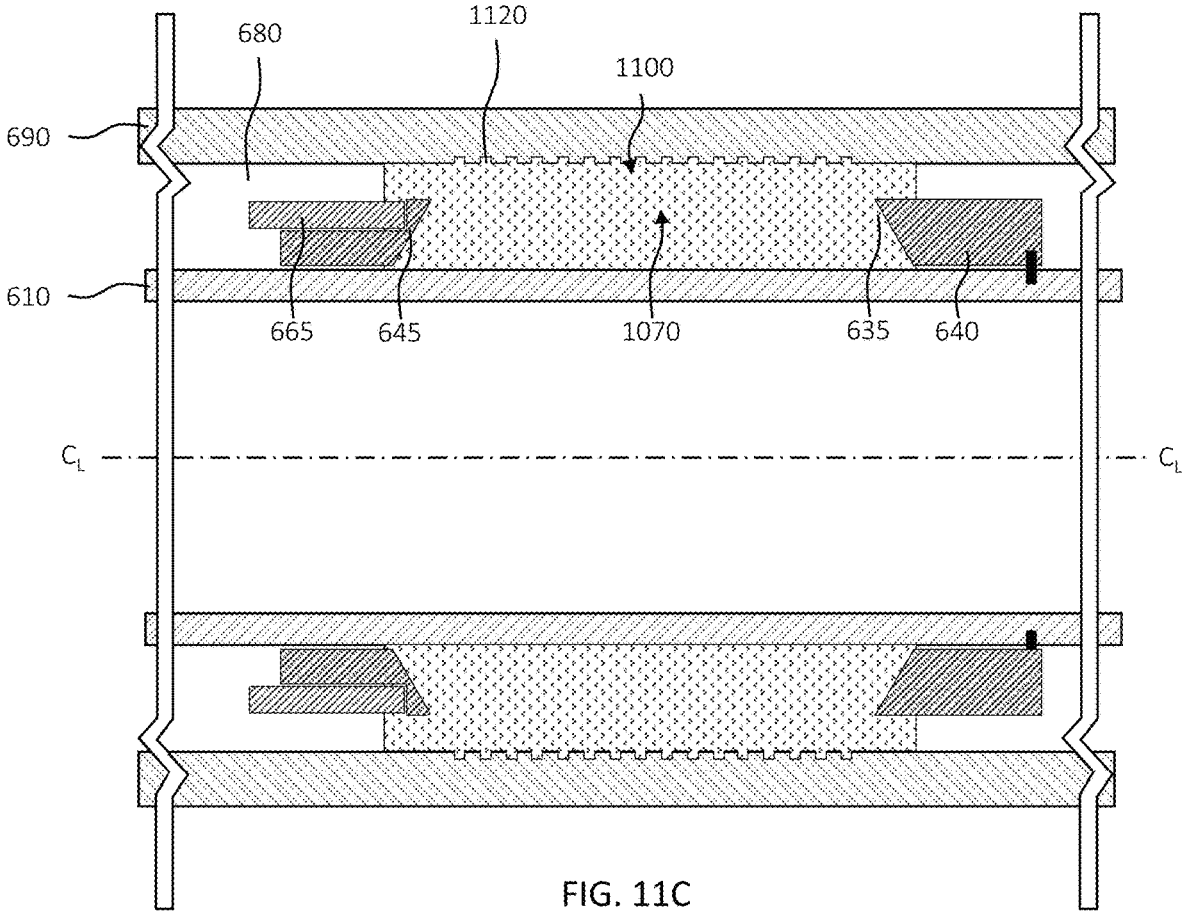

Turning to FIGS. 11A through 11C, depicted are various different deployment states for a sealing/anchoring tool 1100 designed, manufactured and operated according to an alternative embodiment of the disclosure. FIG. 11A illustrates the sealing/anchoring tool 1100 in a run-in-hole state, and thus its sealing/anchoring element is in the radially reduced state, and furthermore the expandable metal has not been subjected to reactive fluid to begin hydrolysis. In contrast, FIG. 11B illustrates the sealing/anchoring tool 1100 with its sealing/anchoring element in the radially enlarged state, but again the expandable metal has not been subjected to reactive fluid to begin hydrolysis. In contrast, FIG. 11C illustrates the sealing/anchoring tool 1100 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1100 is similar in certain respects to the sealing/anchoring tool 1000. Accordingly, like reference numbers have been used to indicate similar, if not identical, features. The sealing/anchoring tool 1100 differs, for the most part, from the sealing/anchoring tool 1000, in that the sealing/anchoring tool 1100 employs a plurality of teeth 1110 located around at least a portion of the outside surface of its circlet 1030. In at least one embodiment, the plurality of teeth 1110 comprise the metal configured to expand in response to hydrolysis, wherein a remainder of the circlet 1030 does not comprise the metal configured to expand in response to hydrolysis. In yet other embodiments, the plurality of teeth 1110 do not comprise a metal configured to expand in response to hydrolysis, but other features of the circlet 1030 do comprise a metal configured to expand in response to hydrolysis. In yet another embodiment, the circlet 1030 and the plurality of teeth 1110 comprise the metal configured to expand in response to hydrolysis. What may result in one or more embodiments, after hydrolysis, is the expanded metal sealing/anchoring element 1070 including a plurality of teeth 1120, as shown in FIG. 11C.

Figure 12A:
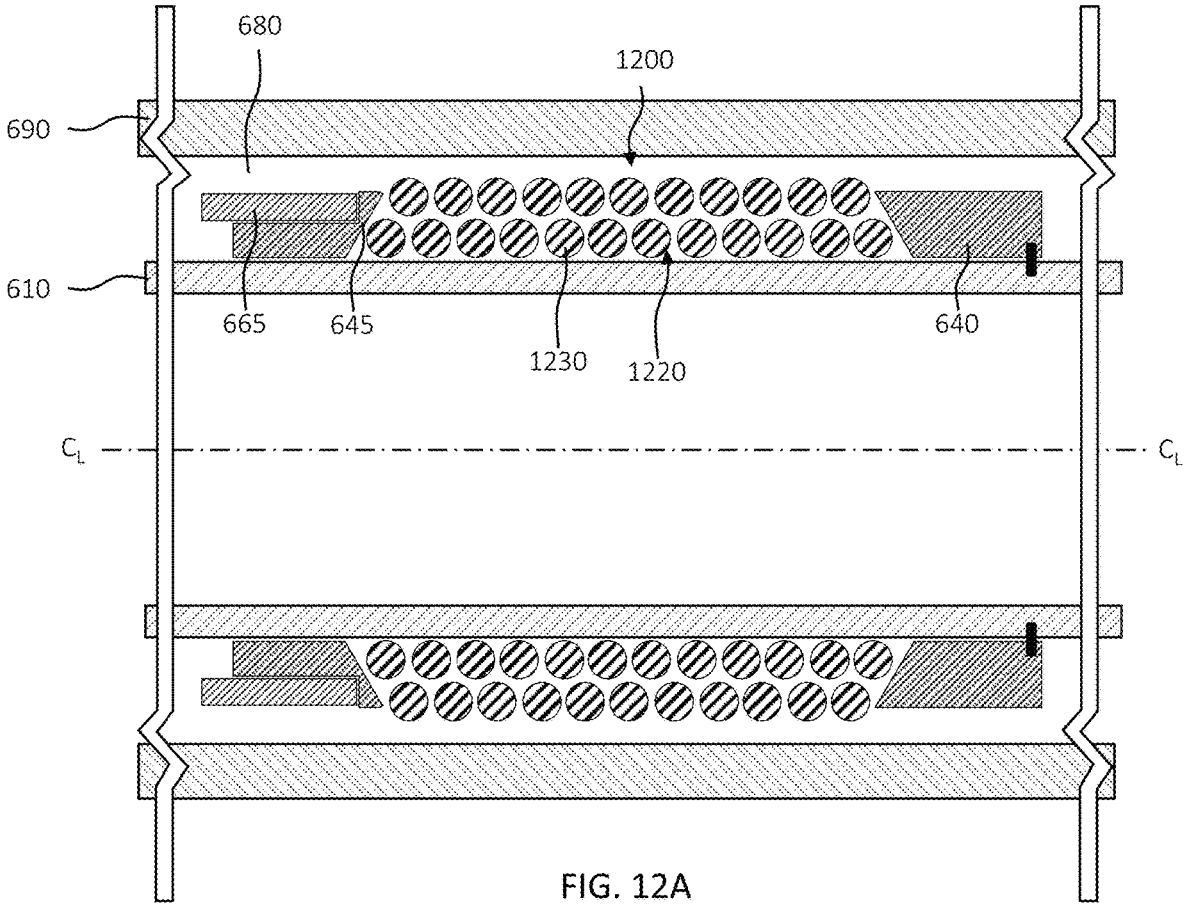
FIGS. 12A through 12C depict various different deployment states for a sealing/anchoring tool designed, manufactured and operated according to an alternative embodiment of the disclosure.
Figure 12B:
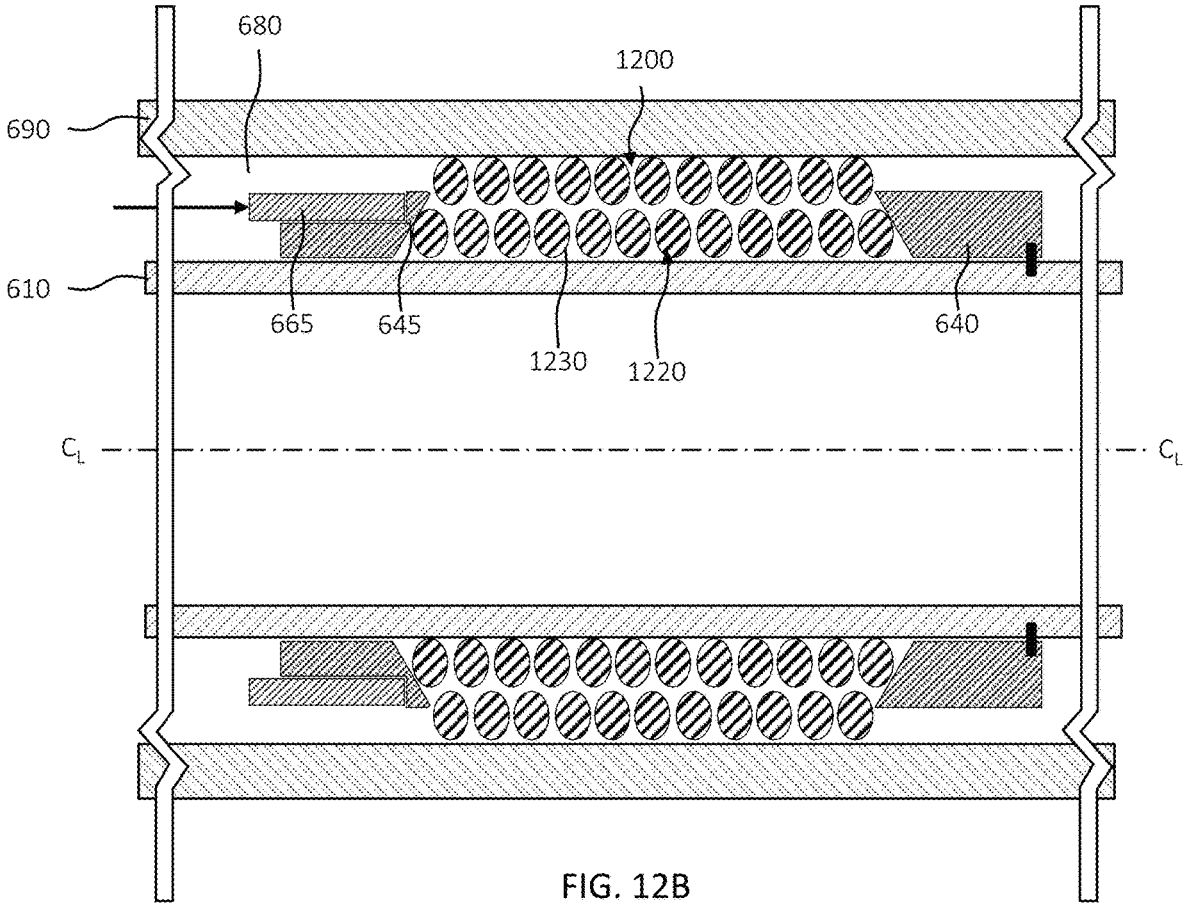
Figure 12C:
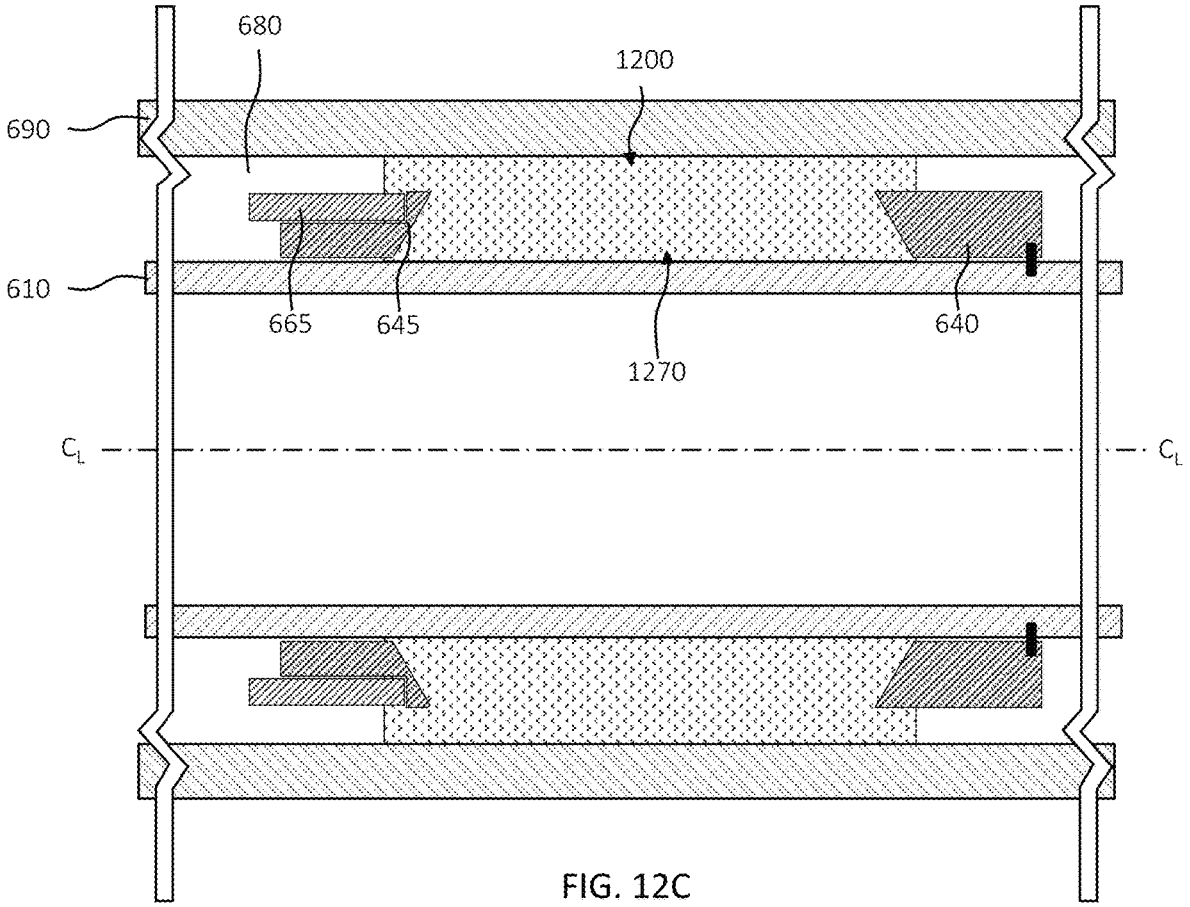

Turning to FIGS. 12A through 12C, depicted are various different deployment states for a sealing/anchoring tool 1200 designed, manufactured and operated according to an alternative embodiment of the disclosure. FIG. 12A illustrates the sealing/anchoring tool 1200 in a run-in-hole state, and thus its sealing/anchoring element is in the radially reduced state, and furthermore the expandable metal has not been subjected to reactive fluid to begin hydrolysis. In contrast, FIG. 12B illustrates the sealing/anchoring tool 1200 with its sealing/anchoring element in the radially enlarged state, but again the expandable metal has not been subjected to reactive fluid to begin hydrolysis. In contrast, FIG. 12C illustrates the sealing/anchoring tool 1200 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1200 is similar in certain respects to the sealing/anchoring tool 600. Accordingly, like reference numbers have been used to indicate similar, if not identical, features. The sealing/anchoring tool 1200 differs, for the most part, from the sealing/anchoring tool 600, in that the sealing/anchoring tool 1200 employs a sealing/anchoring element 1220 including a circlet 1230 that comprises a wire of expandable metal, for example as discussed above. In the illustrated embodiment, the wire of expandable metal wraps around the mandrel 610, and provides the geometric features necessary to allow it to elasto/plastically deform when moved from a radially reduced state to a radially enlarged state with the compression of the wedges 640.

While a single wire of expandable metal may be used, in certain other embodiments a plurality of different wires of expandable metal may be used. In certain embodiments, the wire of expandable metal has a higher surface-area-to-volume ratio (SA:V) than many of the embodiments discussed above, and thus might react faster to the reactive fluid than certain of the other embodiments. What may result in one or more embodiments, after the hydrolysis, is the expanded metal sealing/anchoring element 1270 shown in FIG. 12C.

Figure 13A:
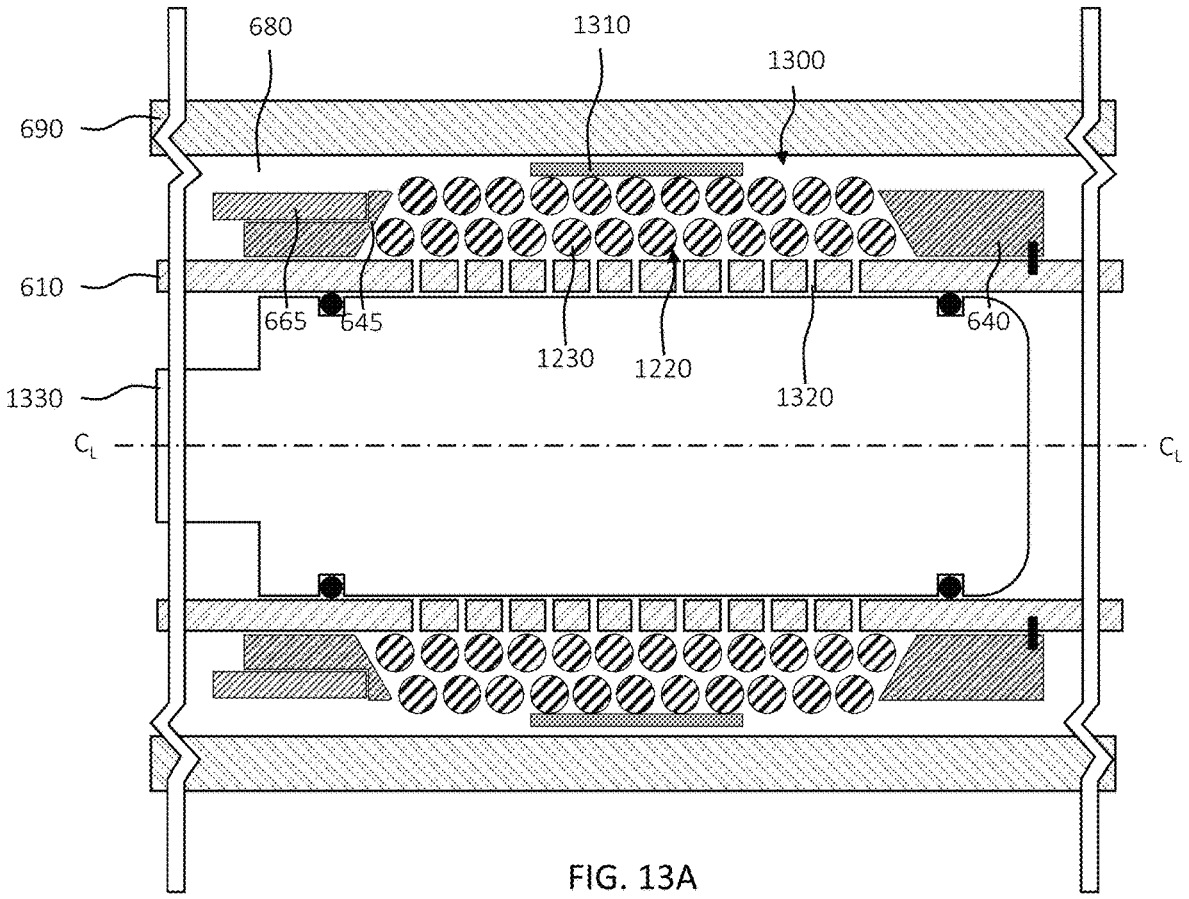
FIGS. 13A through 13C depict various different deployment states for a sealing/anchoring tool designed, manufactured and operated according to an alternative embodiment of the disclosure.
Figure 13B:
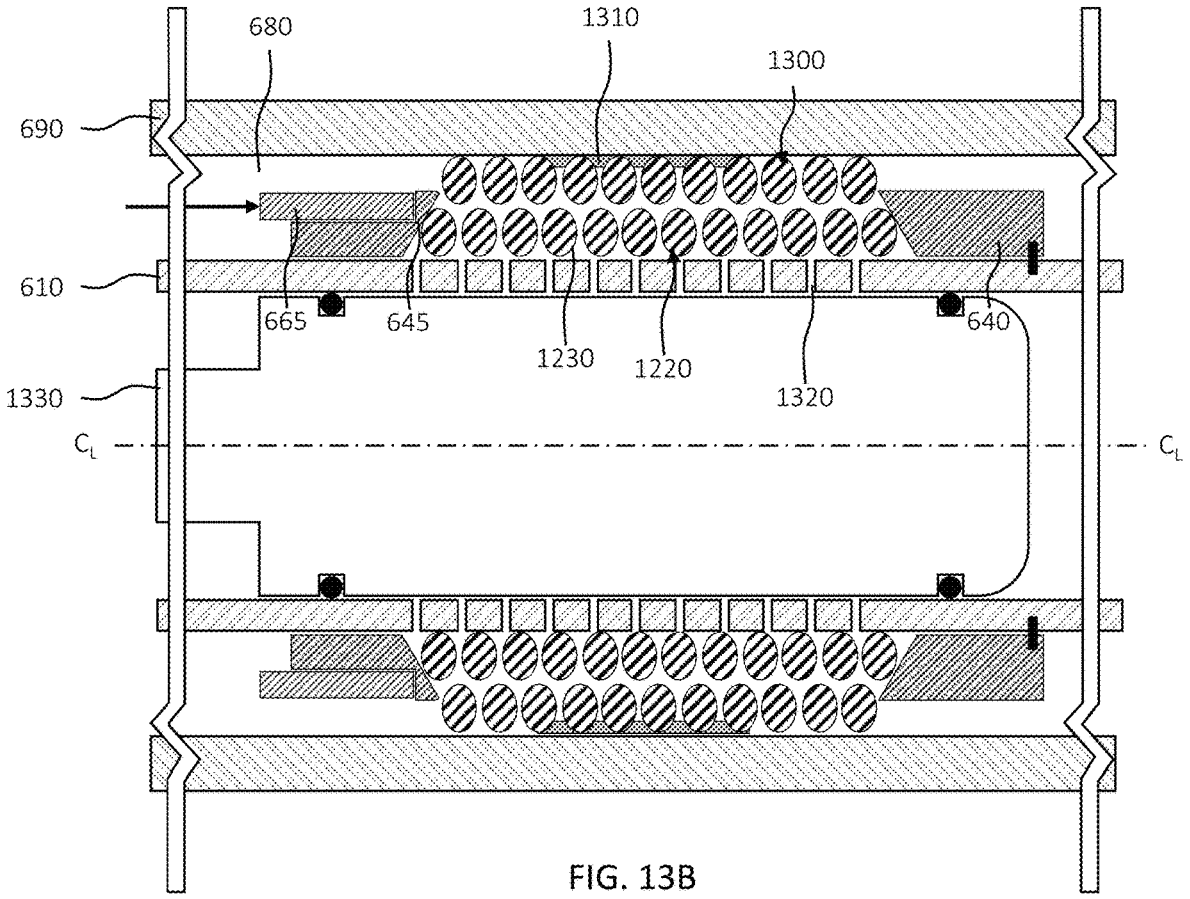
Figure 13C:
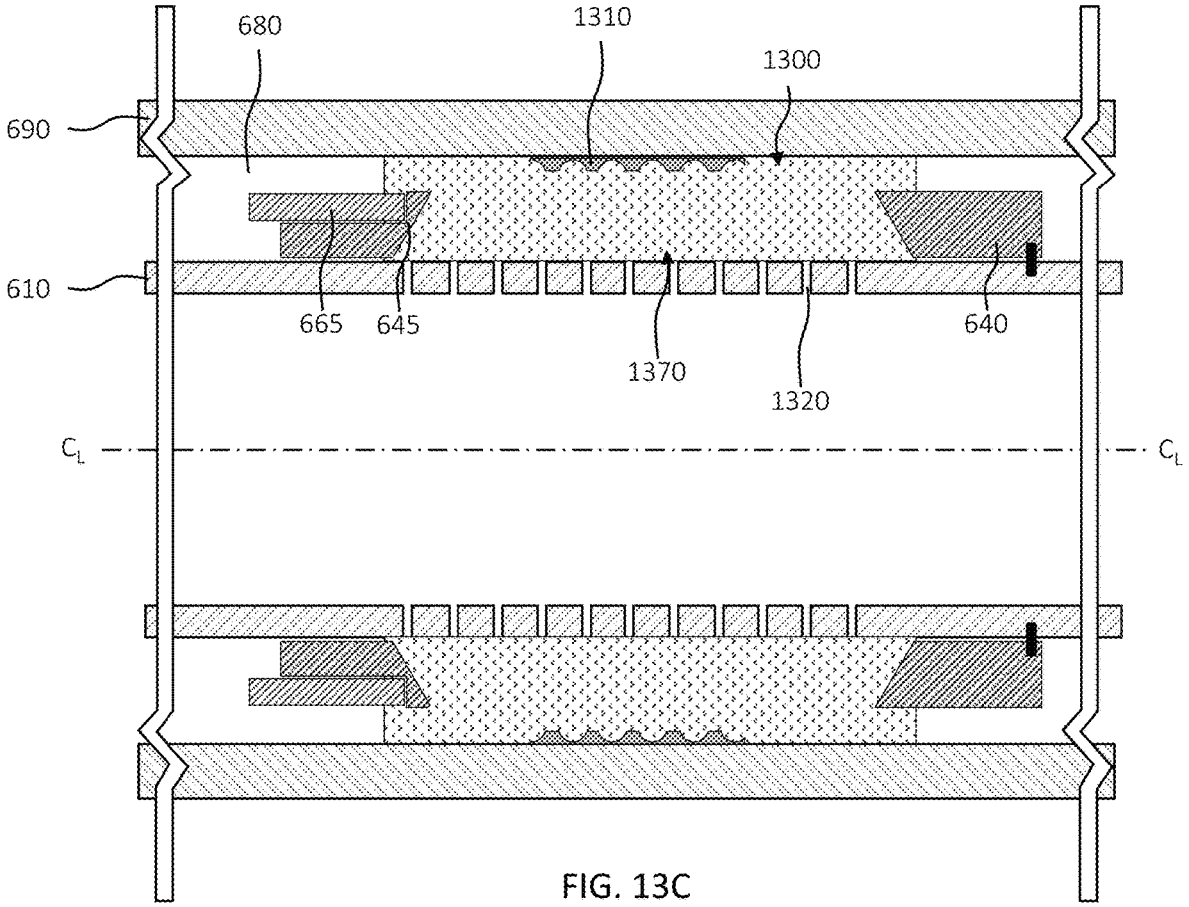

Turning to FIGS. 13A through 13C, depicted are various different deployment states for a sealing/anchoring tool 1300 designed, manufactured and operated according to an alternative embodiment of the disclosure. FIG. 13A illustrates the sealing/anchoring tool 1300 in a run-in-hole state, and thus its sealing/anchoring element is in the radially reduced state, and furthermore the expandable metal has not been subjected to reactive fluid to begin hydrolysis. In contrast, FIG. 13B illustrates the sealing/anchoring tool 1300 with its sealing/anchoring element in the radially enlarged state, but again the expandable metal has not been subjected to reactive fluid to begin hydrolysis. In contrast, FIG. 13C illustrates the sealing/anchoring tool 1300 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1300 is similar in certain respects to the sealing/anchoring tool 1200. Accordingly, like reference numbers have been used to indicate similar, if not identical, features. The sealing/anchoring tool 1300 differs, for the most part, from the sealing/anchoring tool 1200, in that the sealing/anchoring tool 1300 employs a ring of material 1310 fully encircling at least a portion of the outside surface of the circlet 1230. In at least one embodiment, the ring of material 1310 is a thermoplastic ring of material. For example, the ring of material 1310 (e.g., the thermoplastic ring of material) could have the benefit of holding the circlet 1230 together during the run-in-hole state, but then stretch with the circlet 1230 as it moves from the radially reduced state to the radially enlarged state. Additionally, the ring of material 1310 may enhance the seal of the sealing/anchoring element 1300 during the setting process.

The sealing/anchoring tool 1300 additionally differs from the sealing/anchoring tool 1200, in that the sealing/anchoring tool 1300 employs one or more fluid ports 1320 in its mandrel 610. In at least one embodiment, the one or more fluid ports 1320 couple an inside of the mandrel 610 with the circlet 1230 comprising the expandable metal. Accordingly, a sliding seal member 1330 may be used to seal the one or more fluid ports 1320 when the circlet 1230 is in the radially reduced state, and configured to be removed to allow the circlet 1230 to encounter reactive fluid when the circlet 1230 is in the radially enlarged state. FIGS. 13A and 13B illustrate the one or more fluid ports 1320 sealed with the seal member 1330, wherein FIG. 13C illustrates the seal member 1330 having been removed. What may result in one or more embodiments, after the hydrolysis, is the expanded metal sealing/anchoring element 1370 shown in FIG. 13C.

Figure 14A:
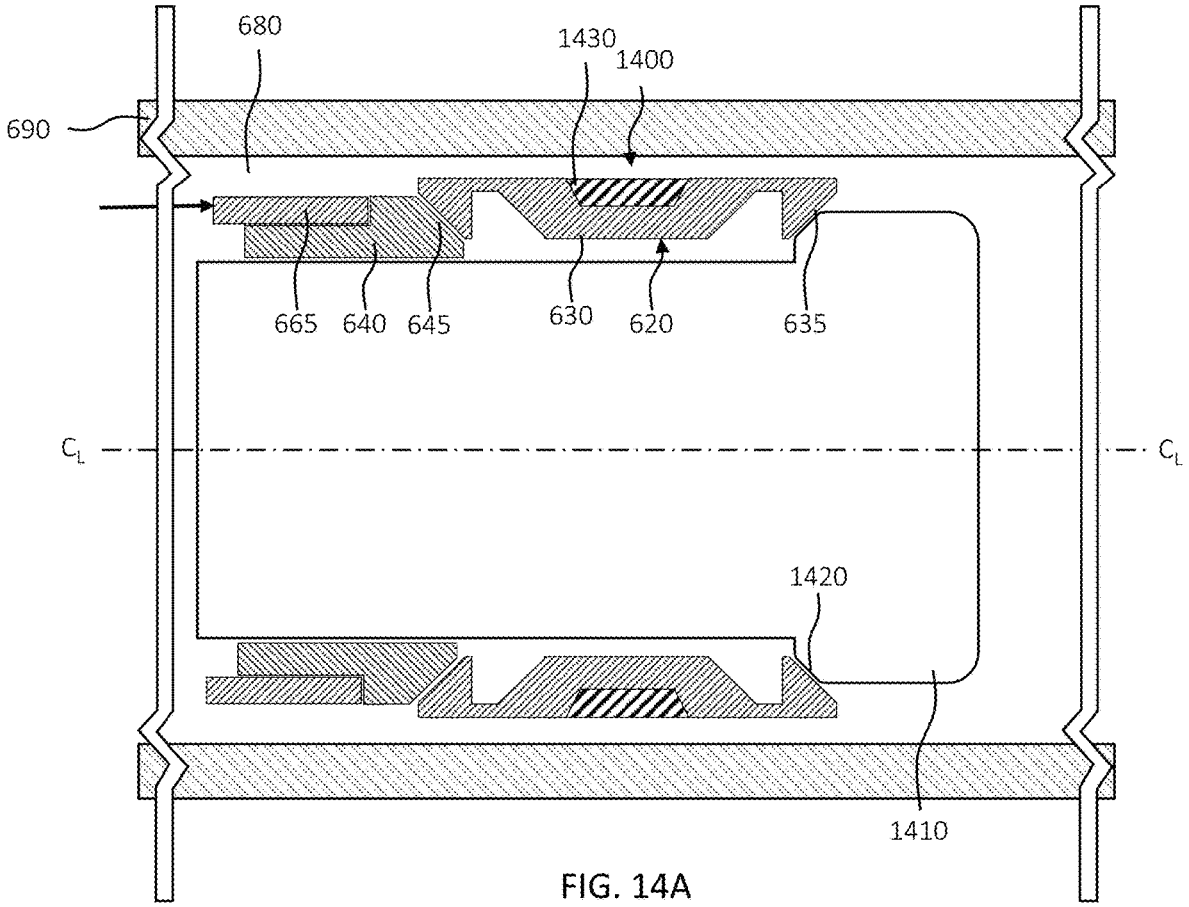
FIGS. 14A through 14C depict various different deployment states for a sealing/anchoring tool designed, manufactured and operated according to an alternative embodiment of the disclosure.
Figure 14B:
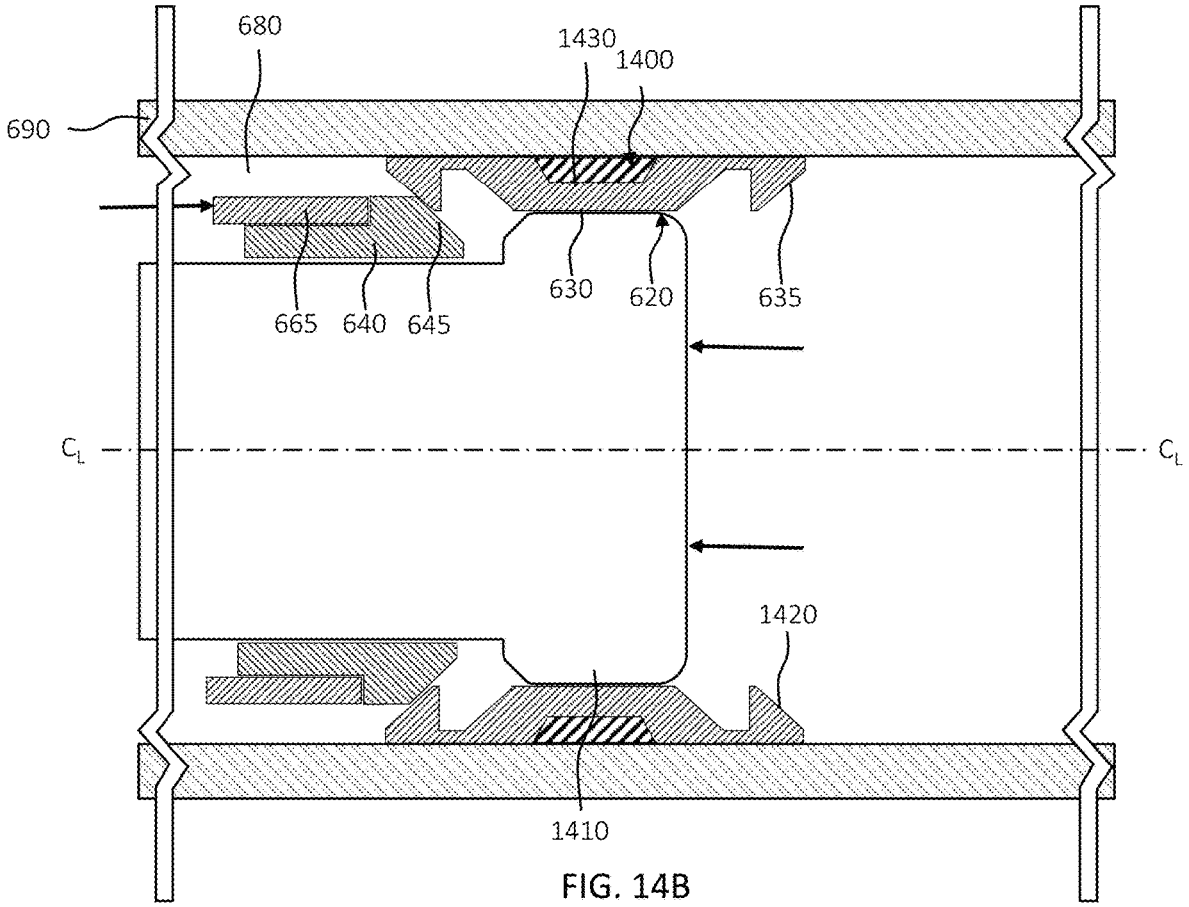
Figure 14C:
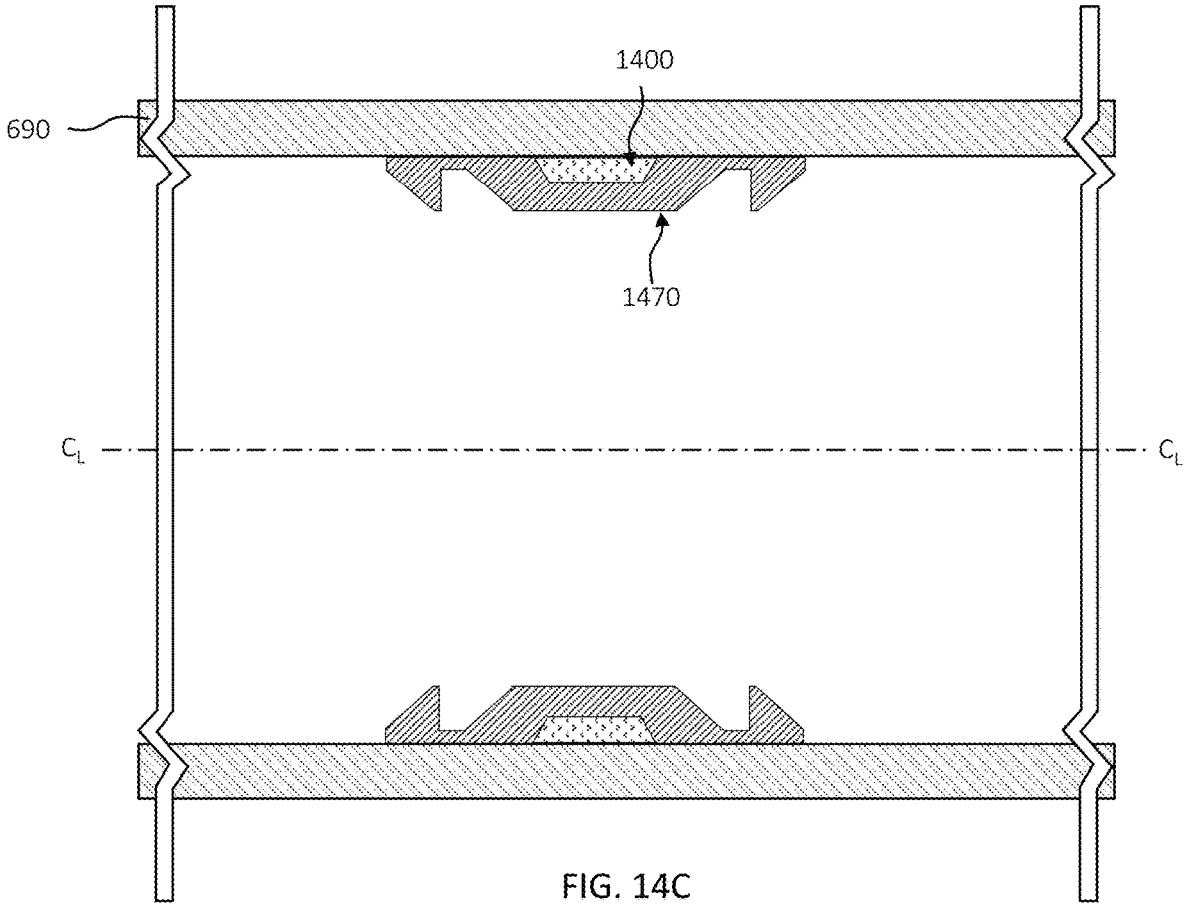

Turning to FIGS. 14A through 14C, depicted are various different deployment states for a sealing/anchoring tool 1400 designed, manufactured and operated according to an alternative embodiment of the disclosure. FIG. 14A illustrates the sealing/anchoring tool 1400 in a run-in-hole state, and thus its sealing/anchoring element is in the radially reduced state, and furthermore the expandable metal has not been subjected to reactive fluid to begin hydrolysis. In contrast, FIG. 14B illustrates the sealing/anchoring tool 1400 with its sealing/anchoring element in the radially enlarged state, but again the expandable metal has not been subjected to reactive fluid to begin hydrolysis. In contrast, FIG. 14C illustrates the sealing/anchoring tool 1400 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1400 is similar in certain respects to the sealing/anchoring tool 600. Accordingly, like reference numbers have been used to indicate similar, if not identical, features. The sealing/anchoring tool 1400 differs, for the most part, from the sealing/anchoring tool 600, in that the sealing/anchoring tool 1400 employs a pull through cone 1410 as a portion of its wedge. In the illustrated embodiment, the pull through cone 1410 is positioned within the inside diameter ($d_i$) of the circlet 630. Thus, as the pull through cone 1410 is axially drawn through the circlet 630, and the angled surface 635 of the circlet 630 engages with an angled surface 1420 of the pull through cone 1410, the circlet 630 moves from the radially reduced state to the radially enlarged state, as shown in FIG. 14B.

Further to the embodiment of FIGS. 14A and 14B, the circlet 630 itself does not comprise the metal configured to expand in response to hydrolysis, but an insert 1430 (e.g., placed within one or more of the geometric features that allow the circlet 630 to elasto/plastically deform) comprising the metal configured to expand in response to hydrolysis is employed. What may result in one or more embodiments, after the pull through cone 1410 is axially drawn through the circlet 630 and after hydrolysis, is the expanded metal sealing/anchoring element 1470 shown in FIG. 14C.

Figure 15A:
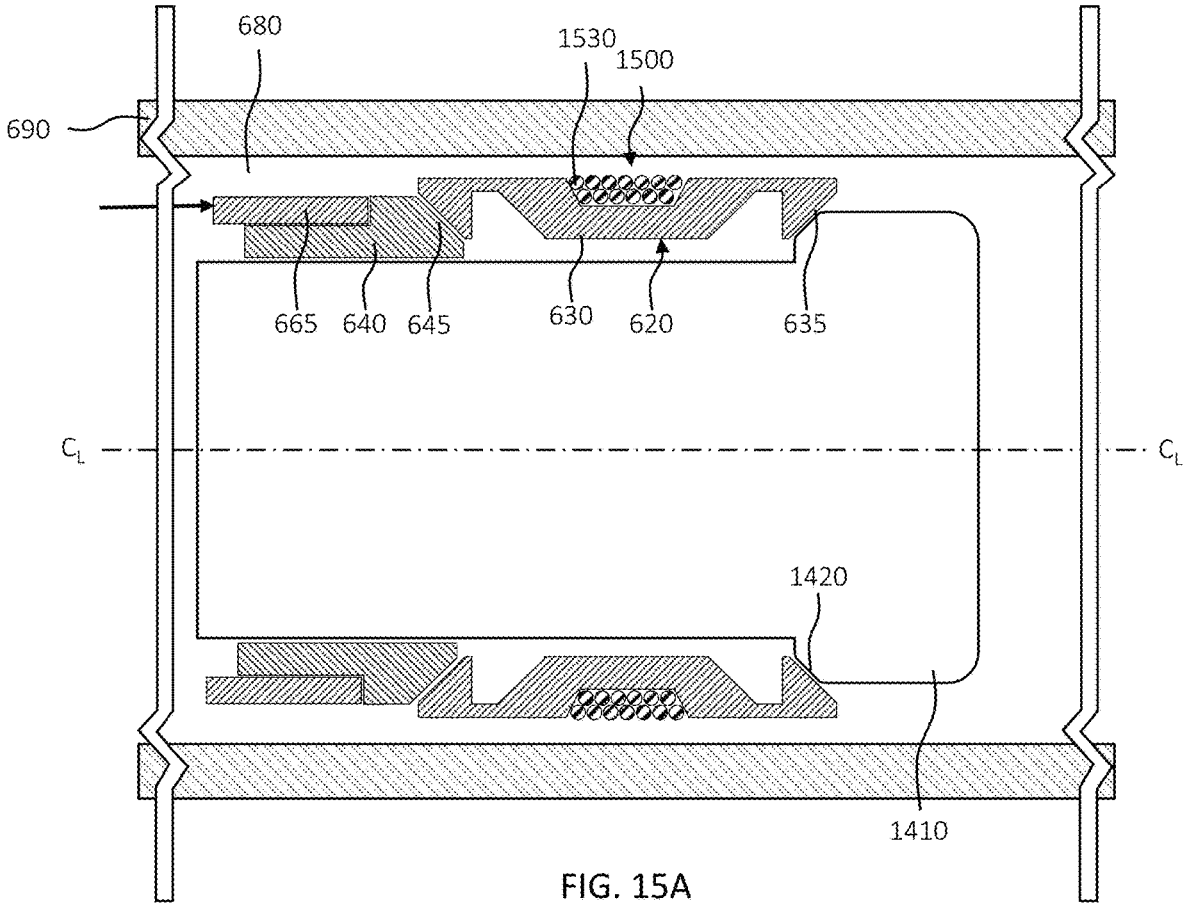
FIGS. 15A through 15C depict various different deployment states for a sealing/anchoring tool designed, manufactured and operated according to an alternative embodiment of the disclosure.
Figure 15B:
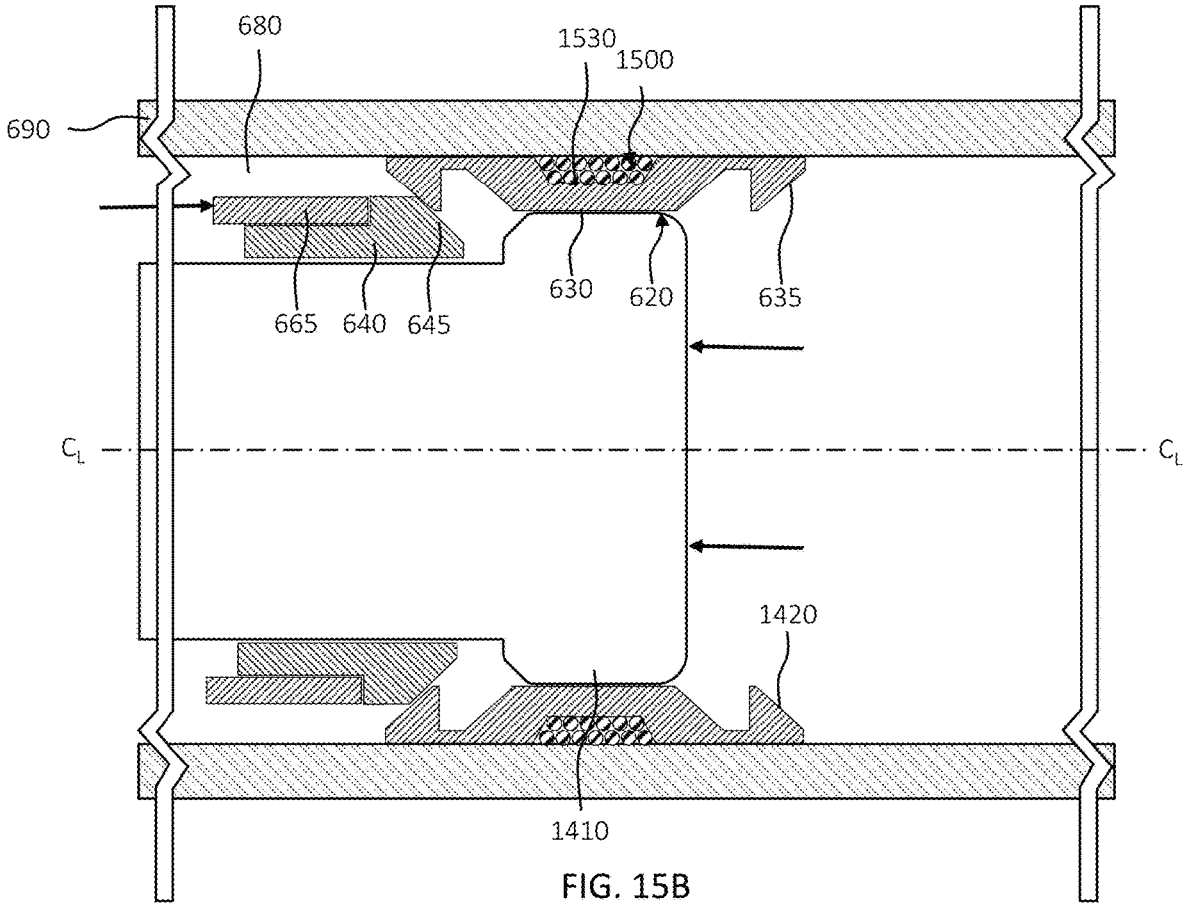
Figure 15C:
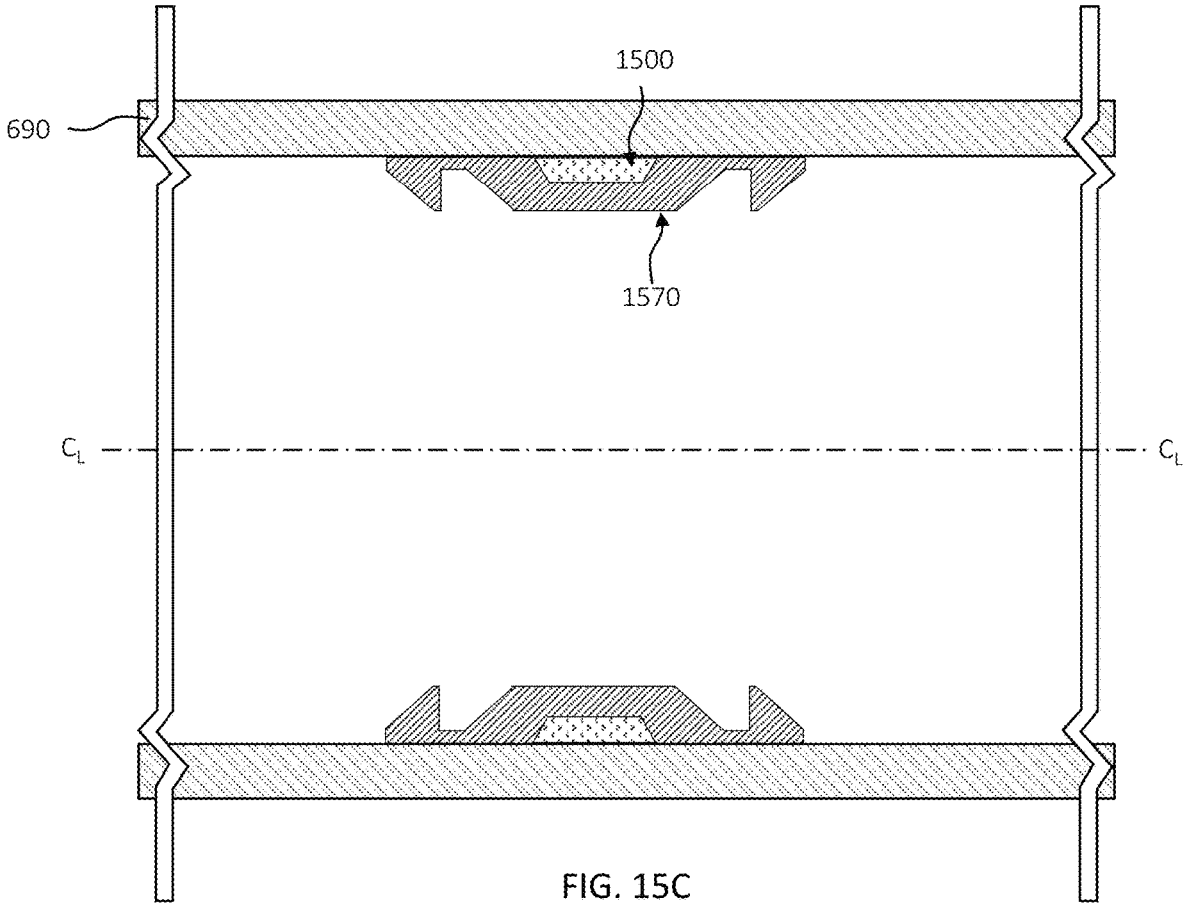

Turning to FIGS. 15A through 15C, depicted are various different deployment states for a sealing/anchoring tool 1500 designed, manufactured and operated according to an alternative embodiment of the disclosure. FIG. 15A illustrates the sealing/anchoring tool 1500 in a run-in-hole state, and thus its sealing/anchoring element is in the radially reduced state, and furthermore the expandable metal has not been subjected to reactive fluid to begin hydrolysis. In contrast, FIG. 15B illustrates the sealing/anchoring tool 1500 with its sealing/anchoring element in the radially enlarged state, but again the expandable metal has not been subjected to reactive fluid to begin hydrolysis. In contrast, FIG. 15C illustrates the sealing/anchoring tool 1500 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1500 is similar in certain respects to the sealing/anchoring tool 1400. Accordingly, like reference numbers have been used to indicate similar, if not identical, features. The sealing/anchoring tool 1500 differs, for the most part, from the sealing/anchoring tool 1400, in that the sealing/anchoring tool 1500 employs a wire insert 1530 (e.g., placed within one or more of the geometric features that allow the circlet 630 to elasto/plastically deform) as the metal configured to expand in response to hydrolysis. What may result in one or more embodiments, after the pull through cone 1410 is axially drawn through the circlet 630 and after hydrolysis, is the expanded metal sealing/anchoring element 1570 shown in FIG. 15C.

Figure 16A:
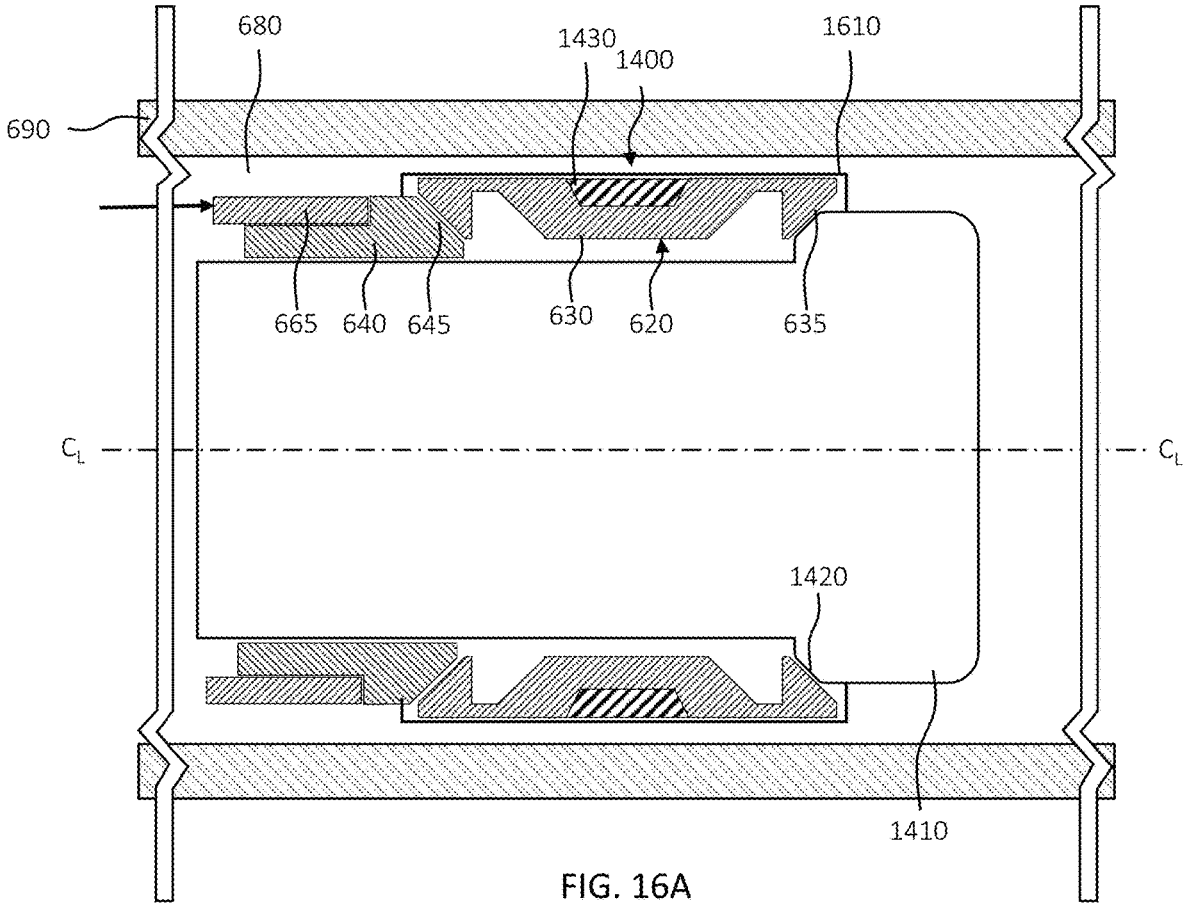
FIGS. 16A through 16C depict various different deployment states for a sealing/anchoring tool designed, manufactured and operated according to an alternative embodiment of the disclosure.
Figure 16B:
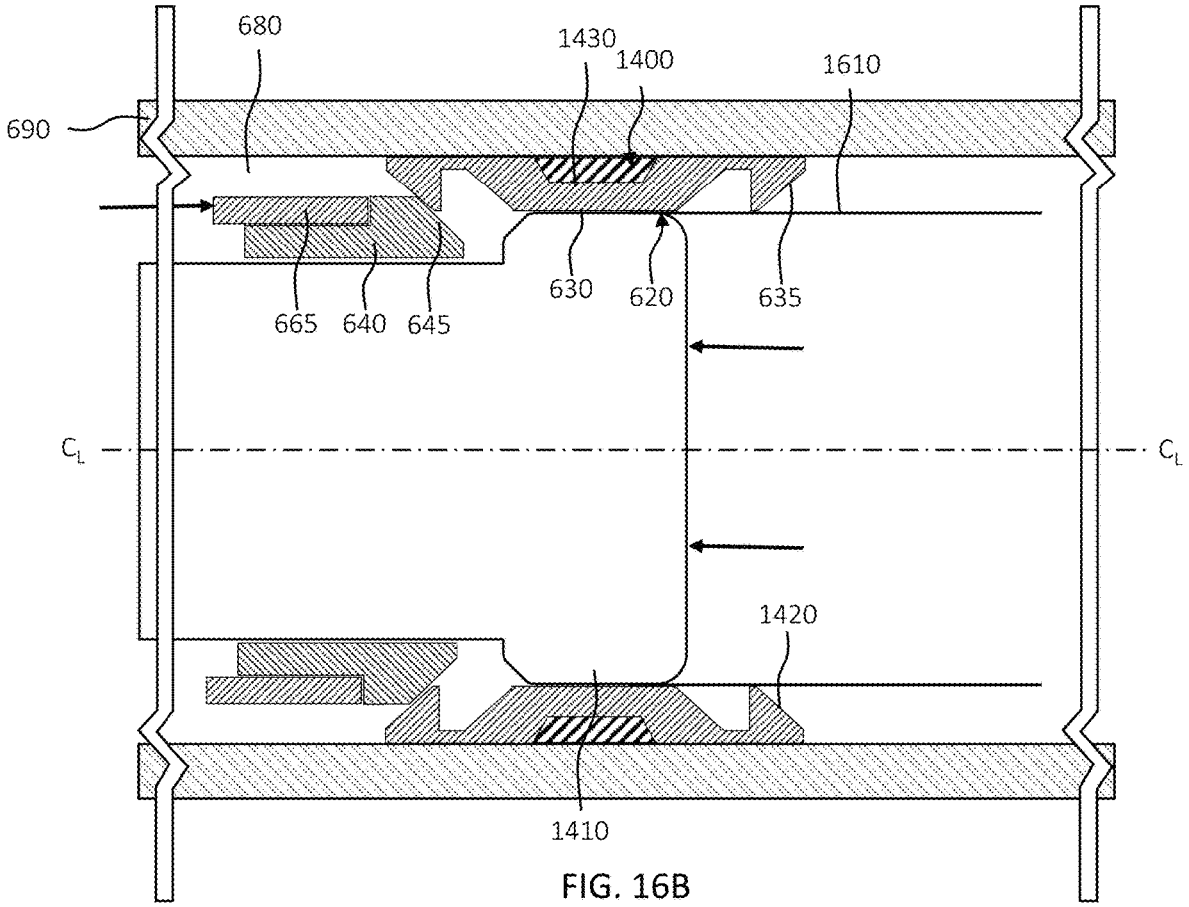
Figure 16C:
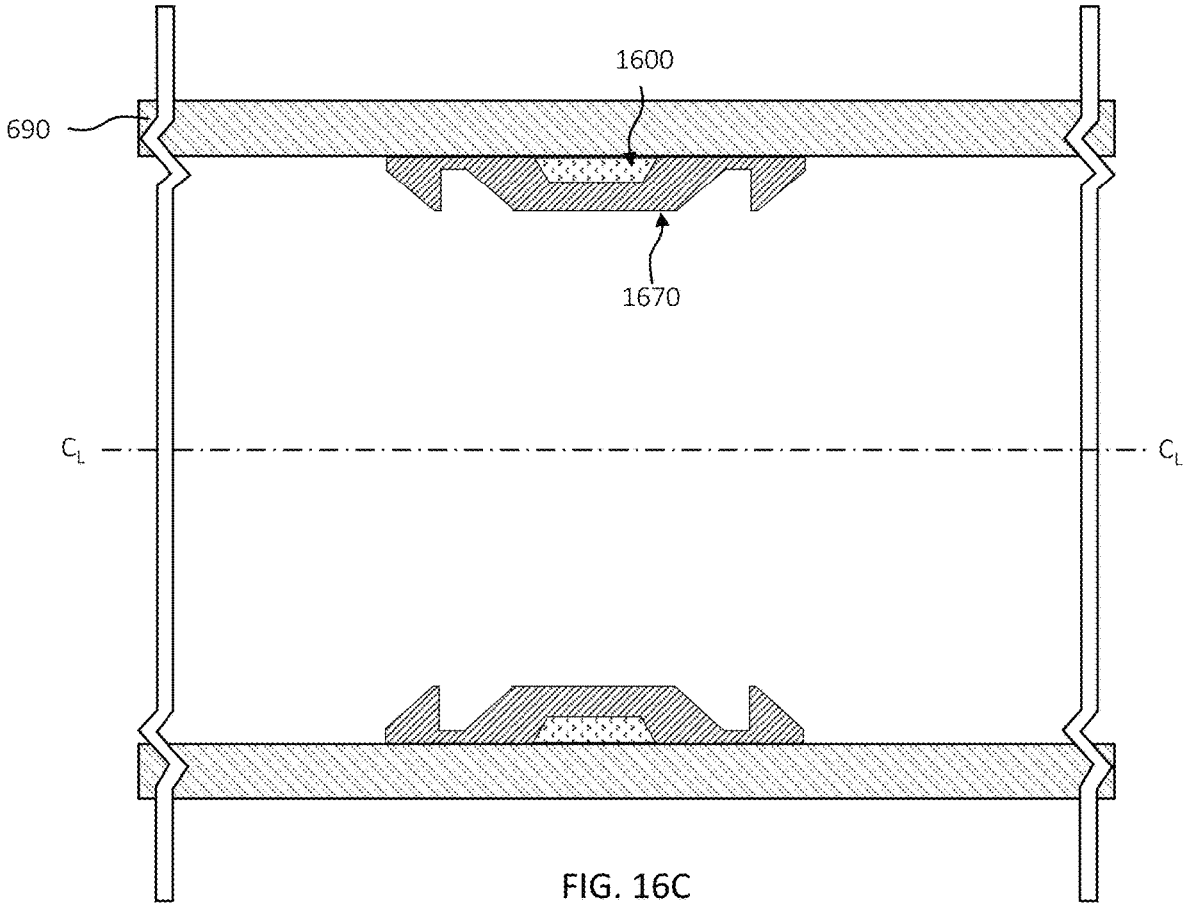

Turning to FIGS. 16A through 16C, depicted are various different deployment states for a sealing/anchoring tool 1600 designed, manufactured and operated according to an alternative embodiment of the disclosure. FIG. 16A illustrates the sealing/anchoring tool 1600 in a run-in-hole state, and thus its sealing/anchoring element is in the radially reduced state, and furthermore the expandable metal has not been subjected to reactive fluid to begin hydrolysis. In contrast, FIG. 16B illustrates the sealing/anchoring tool 1600 with its sealing/anchoring element in the radially enlarged state, but again the expandable metal has not been subjected to reactive fluid to begin hydrolysis. In contrast, FIG. 16C illustrates the sealing/anchoring tool 1600 with its radially enlarged sealing/anchoring element having been subjected to reactive fluid, and thus starting the hydrolysis reaction, thereby forming an expanded metal sealing/anchoring element (e.g., the sealing/anchoring element post-expansion). As disclosed above, the expandable metal may be subjected to a suitable reactive fluid within the wellbore, thereby forming the expanded metal sealing/anchoring element.

The sealing/anchoring tool 1600 is similar in certain respects to the sealing/anchoring tool 1400. Accordingly, like reference numbers have been used to indicate similar, if not identical, features. The sealing/anchoring tool 1600 differs, for the most part, from the sealing/anchoring tool 1400, in that the sealing/anchoring tool 1600 employs a protective cover 1610 over the expandable metal insert 1430. Accordingly, when the protective cover 1610 surrounds the expandable metal insert 1430, reactive fluid may not come into contact with the expandable metal insert 1430. However, in at least one embodiment, as the pull through cone 1410 is axially drawn through the circlet 630, the protective cover 1610 is broken and/or removed, thereby exposing the expandable metal insert 1430 to the reactive fluid. Those skilled in the art understand the various different materials that the protective cover may comprise. What may result in one or more embodiments, after the pull through cone 1410 is axially drawn through the circlet 630 and after hydrolysis, is the expanded metal sealing/anchoring element 1670 shown in FIG. 16C.

Aspects disclosed herein include:

A. A sealing/anchoring element for use with a sealing/anchoring tool, the sealing/anchoring element including: 1) a circlet having an inside surface having an inside diameter ($d_i$), an outside surface having an outside diameter ($d_o$), a width (w), and a wall thickness (t), the circlet having one or more geometric features that allow it to elasto/plastically deform when moved from a radially reduced state to a radially enlarged state, the circlet comprising an expandable metal configured to expand in response to hydrolysis.

B. A sealing/anchoring tool, the sealing/anchoring tool including: 1) a wedge; and 2) a sealing/anchoring element positioned proximate the wedge, the sealing/anchoring element including: a) a circlet having an inside surface having an inside diameter ($d_i$), an outside surface having an outside diameter ($d_o$), a width (w), and a wall thickness (t), the circlet having one or more geometric features that allow it to elasto/plastically deform when one or more angled surfaces positioned along its inside surface or its outside surface engage with the wedge to move the circlet from a radially reduced state to a radially enlarged state, the circlet comprising an expandable metal configured to expand in response to hydrolysis and thereby fix the circlet in the radially enlarged state.

C. A method for sealing/anchoring within a wellbore, the method including: 1) providing a sealing/anchoring tool within a wellbore, the sealing/anchoring tool including: a) a wedge; and b) a sealing/anchoring element positioned proximate the wedge, the sealing/anchoring element including: i) a circlet having an inside surface having an inside diameter ($d_i$), an outside surface having an outside diameter ($d_o$), a width (w), and a wall thickness (t), the circlet having one or more geometric features that allow it to elasto/plastically deform when one or more angled surfaces positioned along its inside surface or its outside surface engage with the wedge to move the circlet from a radially reduced state to a radially enlarged state, the circlet comprising an expandable metal configured to expand in response to hydrolysis and fix the circlet in the radially enlarged state; 2) elasto/plastically deforming the sealing/anchoring element by moving the circlet from the radially reduced state to the radially enlarged state; and 3) subjecting the elasto/plastically deformed sealing/anchoring element in the radially enlarged stated to reactive fluid to form an expanded metal sealing/anchoring element.

Aspects A, B, and C may have one or more of the following additional elements in combination: Element 1: wherein the circlet is a barrel slip. Element 2: wherein the barrel slip includes two or more geometric alternating cuts to allow the barrel slip to elastically deform when moved from the radially reduced state to the radially enlarged state. Element 3: wherein the barrel slip includes a ring of material fully encircling at least a portion of the outside surface. Element 4: wherein the ring of material is a thermoplastic ring of material. Element 5: wherein the barrel slip has a plurality of teeth located around at least a portion of the outside surface. Element 6: wherein the plurality of teeth comprise the metal configured to expand in response to hydrolysis. Element 7: wherein the outside surface comprises the expandable metal configured to expand in response to hydrolysis, and the plurality of teeth comprise a material not configured to expand in response to hydrolysis. Element 8: wherein the circlet is a football shaped member having an opening extending therethrough and a geometric larger area of material removed from a center thereof. Element 9: wherein the football shaped member has a plurality of teeth located around at least a portion of the outside surface. Element 10: wherein the circlet has one or more angled surfaces positioned along its inside surface or its outside surface, the one or more angled surfaces configured to engage one or more associated wedges of a sealing/anchoring tool to move the circlet from the radially reduced state to the radially enlarged state. Element 11: wherein the wedge and the sealing/anchoring element are positioned about a mandrel, the wedge configured to axially slide along the mandrel relative to the circlet to move the circlet from the radially reduced state to the radially enlarged state. Element 12: wherein the wedge is a first wedge and further including a second wedge, wherein the first and second wedges are located on opposing sides of the sealing/anchoring element, the first and second wedges configured to axial slide along the mandrel relative to one another to move the circlet from the radially reduced state to the radially enlarged state. Element 13: wherein the mandrel, the first wedge, the second wedge and the sealing/anchoring element form at least a portion of a frac plug. Element 14: wherein the mandrel includes one or more fluid ports coupling an inside of the mandrel with the circlet comprising the expandable metal configured to expand in response to hydrolysis. Element 15: further including a sliding seal member sealing the one or more fluid ports, the sliding seal member configured to seal the one or more fluid ports when the circlet is in the radially reduced state and configured to be removed to allow the circlet to encounter reactive fluid to cause the expandable metal to expand in response to hydrolysis when the circlet is in the radially enlarged state. Element 16: wherein the wedge is part of a pull through cone positioned within the inside diameter ($d_i$), the wedge of the pull through cone configured to move the circlet from the radially reduced state to the radially enlarged state as the pull through cone is axially drawn through the circlet. Element 17: wherein the one or more geometric features allow the circlet to elastically deform. Element 18: wherein the one or more geometric features allow the circlet to plastically deform. Element 19: wherein the circlet is a barrel slip including two or more geometric alternating cuts to allow the barrel slip to elastically deform when moved from the radially reduced state to the radially enlarged state. Element 20: wherein the barrel slip includes a thermoplastic ring of material fully encircling at least a portion of the outside surface. Element 21: wherein the barrel slip has a plurality of teeth located around at least a portion of the outside surface. Element 22: wherein the circlet is a football shaped member having an opening extending therethrough and a geometric larger area of material removed from a center thereof. Element 23: wherein the football shaped member has a plurality of teeth located around at least a portion of the outside surface. Element 24: wherein elasto/plastically deforming the sealing/anchoring element includes axially drawing a pull through cone having the wedge through the inside diameter ($d_i$) to move the circlet from the radially reduced state to the radially enlarged state. Element 25: wherein the wedge and the sealing/anchoring element are positioned about a mandrel having one or more fluid ports coupling an inside of the mandrel with the circlet, and further wherein a sliding seal member seals the one or more fluid ports, wherein subjecting the elasto/plastically deformed sealing/anchoring element in the radially enlarged stated to reactive fluid includes removing the sliding seal member to allow the elasto/plastically deformed sealing/anchoring element in the radially enlarged stated to encounter the reactive fluid. Element 26: wherein elasto/plastically deforming the sealing/anchoring element includes elastically deforming the sealing/anchoring element. Element 27: wherein elasto/plastically deforming the sealing/anchoring element includes plastically deforming the sealing/anchoring element. Element 28: wherein elasto/plastically deforming the sealing/anchoring element includes elastically and plastically deforming the sealing/anchoring element.

Those skilled in the art to which this application relates will appreciate that other and further additions, deletions, substitutions and modifications may be made to the described embodiments.

What is claimed is:

1. A well system, comprising:

a bore;

a sealing anchoring tool positioned within the bore, the sealing anchoring tool including:

a mandrel;

a wedge positioned about the mandrel; and a sealing/anchoring element positioned about the mandrel and proximate the wedge, the sealing/anchoring element including:

a circlet having an inside surface having an inside diameter ($d_i$), an outside surface having an outside diameter ($d_o$), a width (w), and a wall thickness (t), the circlet having one or more geometric features that allow it to elasto/plastically deform when one or more angled surfaces positioned along its inside surface or its outside surface engage with the wedge to move the circlet from a radially reduced state to a radially enlarged state, the circlet comprising an expandable metal configured to expand in response to hydrolysis and thereby fix the circlet in the radially enlarged state, and further wherein during the expansion, the expandable metal is configured to go from metal to micron-scale particles that are larger and lock together, and further wherein the mandrel comprises a first material configured to remain within the bore and provide a radial surface upon which the circlet may radially engage when expanding in response to hydrolysis, and the wedge comprises a second material configured to remain within the bore and provide an axial surface upon which the circlet may axially engage when expanding in response to hydrolysis.

2. The well system as recited in claim 1, wherein the wedge is configured to axially slide along the mandrel relative to the circlet to move the circlet from the radially reduced state to the radially enlarged state.

3. The well system as recited in claim 2, wherein the wedge is a first wedge and further including a second wedge, wherein the first and second wedges are located on opposing sides of the sealing/anchoring element, the first and second wedges configured to axial slide along the mandrel relative to one another to move the circlet from the radially reduced state to the radially enlarged state.

4. The well system as recited in claim 3, wherein the mandrel, the first wedge, the second wedge and the sealing/anchoring element form at least a portion of a frac plug.

5. The well system as recited in claim 2, wherein the mandrel includes one or more fluid ports coupling an inside of the mandrel with the circlet comprising the expandable metal configured to expand in response to hydrolysis.

6. The well system as recited in claim 5, further including a sliding seal member sealing the one or more fluid ports, the sliding seal member configured to seal the one or more fluid ports when the circlet is in the radially reduced state and configured to be removed to allow the circlet to encounter reactive fluid to cause the expandable metal to expand in response to hydrolysis when the circlet is in the radially enlarged state.

7. The well system as recited in claim 1, wherein the wedge is part of a pull through cone positioned within the inside diameter ($d_i$), the wedge of the pull through cone configured to move the circlet from the radially reduced state to the radially enlarged state as the pull through cone is axially drawn through the circlet.

8. The well system as recited in claim 1, wherein the one or more geometric features allow the circlet to elastically deform.

9. The well system as recited in claim 1, wherein the one or more geometric features allow the circlet to plastically deform.

10. The well system as recited in claim 1, wherein the circlet is a barrel slip including two or more geometric alternating cuts to allow the barrel slip to elastically deform when moved from the radially reduced state to the radially enlarged state.

11. The well system as recited in claim 10, wherein the barrel slip includes a thermoplastic ring of material fully encircling at least a portion of the outside surface.

12. The well system as recited in claim 10, wherein the barrel slip has a plurality of teeth located around at least a portion of the outside surface.

13. The well system as recited in claim 1, wherein the circlet is a football shaped member having an opening extending therethrough and a geometric larger area of material removed from a center thereof.

14. The well system as recited in claim 13, wherein the football shaped member has a plurality of teeth located around at least a portion of the outside surface.

15. A method for sealing/anchoring within a wellbore, comprising:

providing a sealing/anchoring tool within a bore of a wellbore, the sealing/anchoring tool including:

a mandrel;

a wedge positioned about the mandrel; and a sealing/anchoring element positioned about the mandrel and proximate the wedge, the sealing/anchoring element including:

a circlet having an inside surface having an inside diameter ($d_i$), an outside surface having an outside diameter ($d_o$), a width (w), and a wall thickness (t), the circlet having one or more geometric features that allow it to elasto/plastically deform when one or more angled surfaces positioned along its inside surface or its outside surface engage with the wedge to move the circlet from a radially reduced state to a radially enlarged state, the circlet comprising an expandable metal configured to expand in response to hydrolysis and fix the circlet in the radially enlarged state, and further wherein during the expansion, the expandable metal is configured to go from metal to micron-scale particles that are larger and lock together, and further wherein the mandrel comprises a first non-degradable material configured to remain within the bore and provide a radial surface upon which the circlet may radially engage when expanding in response to hydrolysis, and the wedge comprises a second non-degradable material configured to remain within the bore and provide an axial surface upon which the circlet may axially engage when expanding in response to hydrolysis;

elasto/plastically deforming the sealing/anchoring element by moving the circlet from the radially reduced state to the radially enlarged state; and subjecting the elasto/plastically deformed sealing/anchoring element in the radially enlarged stated to reactive fluid to form an expanded metal sealing/anchoring element.

16. The method as recited in claim 15, wherein elasto/plastically deforming the sealing/anchoring element includes axially drawing a pull through cone having the wedge through the inside diameter ($d_i$) to move the circlet from the radially reduced state to the radially enlarged state.

17. The method as recited in claim 15, wherein the wedge and the sealing/anchoring element are positioned about the mandrel having one or more fluid ports coupling an inside of the mandrel with the circlet, and further wherein a sliding seal member seals the one or more fluid ports, wherein subjecting the elasto/plastically deformed sealing/anchoring element in the radially enlarged stated to reactive fluid includes removing the sliding seal member to allow the elasto/plastically deformed sealing/anchoring element in the radially enlarged stated to encounter the reactive fluid.

18. The method as recited in claim 15, wherein elasto/plastically deforming the sealing/anchoring element includes elastically deforming the sealing/anchoring element.

19. The method as recited in claim 15, wherein elasto/plastically deforming the sealing/anchoring element includes plastically deforming the sealing/anchoring element.

20. The method as recited in claim 15, wherein elasto/plastically deforming the sealing/anchoring element includes elastically and plastically deforming the sealing/anchoring element.

* * * * *